US007229075B2

(12) United States Patent
Foster et al.

(10) Patent No.: US 7,229,075 B2
(45) **Date of Patent: *Jun. 12, 2007**

(54) APPARATUS AND METHOD OF PLAYING CRIBBAGE AS A CASINO GAME AND AS A SLOT MACHINE

(75) Inventors: Brian Keith Foster, Stateline, NV (US); Mark John Spur, Stateline, NV (US)

(73) Assignee: Shuffle Master, Inc, Las Vegas, NV (US)

( * ) Notice: Subject to any disclaimer, the term of this patent is extended or adjusted under 35 U.S.C. 154(b) by 227 days.

This patent is subject to a terminal disclaimer.

(21) Appl. No.: 10/918,634

(22) Filed: Aug. 13, 2004

(65) Prior Publication Data

US 2005/0073101 A1 Apr. 7, 2005

Related U.S. Application Data

(63) Continuation of application No. 10/293,905, filed on Nov. 12, 2002, now Pat. No. 6,824,137.

(51) Int. Cl.
*A63F 1/00* (2006.01)

(52) U.S. Cl. ..... 273/292; 273/274

(58) Field of Classification Search ..... 273/292, 273/274, 309; 463/12, 13; 464/13, 12
See application file for complete search history.

(56) References Cited

U.S. PATENT DOCUMENTS

| | | | | |
|---|---|---|---|---|
| 4,854,586 | A | 8/1989 | Morse | 273/249 |
| 4,902,018 | A | 2/1990 | Morse | 273/249 |
| 5,028,765 | A | 7/1991 | Hull et al. | 235/90 |
| 5,090,106 | A | 2/1992 | Fink | 29/525 |
| 5,240,249 | A | 8/1993 | Czarnecki et al. | 273/85 |
| 5,590,883 | A | 1/1997 | Brewer | 273/249 |
| 5,653,635 | A | 8/1997 | Breeding | 463/11 |
| 5,794,934 | A * | 8/1998 | Malcolm | 273/292 |
| 5,879,233 | A | 3/1999 | Stupero | 463/11 |
| 6,257,577 | B1 | 7/2001 | Sutton | 273/246 |
| 6,554,282 | B2 | 4/2003 | Vanderkley et al. | |
| 2002/0132658 | A1 | 9/2002 | Brown et al. | 463/16 |

OTHER PUBLICATIONS

W. B. Gibson, *Hoyle's Modern Encyclopedia Of Card Games*, pp. 95-100, 1974.

Chapter VII: Cribbage and Counting Games, *Bicycle Official Rules of Card Games*, The United States Playing Card Company, 90th Edition, pp. 254-263, 2002 (no month).

Gibson, Walter B.. Hoyle's Modern Encyclopedia of Card Games, 1974, Nov. 2001, pp. 95-100.

Chapter VII: Cribbage and Counting Games, *Bicycle Official Rules of Card Games*, The United States Playing Card Company, 90th Edition, pp. 254-263, 2002 (no month).

* cited by examiner

*Primary Examiner*—Benjamin Layno
(74) *Attorney, Agent, or Firm*—Mark A. Litman & Associates, P.A.

(57) ABSTRACT

A method of playing a casino table version of cribbage using at least one deck of conventional playing cards, having at least one player making a wager and a dealer that deals the cards. The method includes having at least one player making a wager to receive a plurality of cards. Next, the cards are dealt to each player and the dealer is dealt a plurality of cards, wherein four random cards are dealt to create the dealer hand. The players discard either one or two cards depending on the method chosen. The dealer then exposes his cards and discards two cards. Next, the starter card is exposed. Finally, the players' cards are exposed and values of the hands are computed and compared to the dealer's hand. The method includes determining whether the players win or lose their wager.

74 Claims, 24 Drawing Sheets

APPARATUS AND METHOD OF PLAYING CRIBBAGE AS A CASINO GAME AND AS A SLOT MACHINE

CROSS-REFERENCE TO RELATED APPLICATIONS

This application is a continuation of U.S. patent application Ser. No. 10/293,905, filed Nov. 12, 2002 now U.S Pat. No. 6,824,137.

BACKGROUND OF THE SYSTEM

1. Field of the System

The present system relates to a method of playing a cribbage game. More specifically, the present system relates to a modification of the method of playing a cribbage game. The modification to the game involves a method of playing the game as a casino table game, a card room game or a video slot machine game.

2. Background

The conventional cribbage game involves two players, a deck of 52 playing cards and a cribbage pegboard. As used in this patent application, "conventional cribbage" and the "conventional manner of playing cribbage" is defined as the game of cribbage as described on pages 254–263 of "Bicycle Official Rules of Card Games", Joli Quentin Kansil, Editor, The United States Playing Card Company publishers, and incorporated by reference herein.

In conventional cribbage, the dealer distributes six cards face down to his opponent and himself, beginning with the opponent. The object of the game is to be the first player to score 121 points (some games are to 61 points). Players earn points during play and for making various card combinations. A detailed description of the scoring method is set forth below.

Next, each player looks at his or her six cards and "lays away" two of them face down to reduce the hand to four. The four cards laid away together constitute "the Crib". The crib belongs to the dealer, but these cards are not exposed or used until after the hands have been played.

After the hand is dealt and the crib hand is laid away, the non-dealer cuts the deck. The dealer turns up the top card of the lower packet and places it face up on top of the deck. This card is the "starter". If the starter card is a jack, it is called "his heels," and the dealer pegs (scores) 2 points at once. The starter is not used in the play phase of Cribbage, but is used later for making various card combinations that score points.

After the starter is turned, the non-dealer lays one of his cards face up on the table. The dealer similarly exposes a card, then non-dealer again and so on. The hands are exposed card-by-card, alternately except for a "Go," as set forth in detail below. Each player keeps his card separate from his opponent.

As each per play, he announces a running total of "pips" reached by the addition of the last card to those already played. For example, the non-dealer begins with a five saying "five." The dealer plays a seven saying "twelve." The kings, queens and jacks all count for 10 points each, aces are low each counting for 1 point.

During play, the running total of cards may never exceed 31. If a player cannot add another card without exceeding 31, he or she says "Go" and the opponent pegs 1. After gaining the Go, the opponent must first lay down any additional cards he can without exceeding 31. Besides the point for Go, he may then score any additional points that can be made through pairs and runs, described in detail below. If a player reaches exactly 31, he pegs two instead of one for Go.

The player who called Go leads for the next series of plays, with the count starting at zero. The lead may not be combined with any cards previously played to form a scoring combination; the Go has interrupted the sequence.

The person who plays the last card pegs one for Go, plus one extra of the card brings the count to exactly 31. The dealer is sure to peg at least one point in every hand, because he will have a Go on the last card if not earlier.

The object in the game is to score points by pegging, In addition to a Go, a player may score for the following combinations:

| | |
|---|---|
| Fifteen - adding a card that makes the total 15 | Peg 2 |
| Pair - For adding a card of the same rank as one just played. | Peg 2 |
| Triplet - For adding a third card of the same rank. | Peg 6 |
| Four - For adding a fourth card of the same rank. | Peg 12 |

Run: For adding a card that forms with those just played:

| | |
|---|---|
| For a sequence of three. | Peg 3 |
| For a sequence of four. | Peg 4 |
| For a sequence of five. | Peg 5 |

When the play ends, the three hands are counted in order: non-dealer's is counted hand first, dealer's hand is counted second, and then the crib hand is counted last. When counting hands, the starter is considered to be part of each hand, so that the hands in counting each comprise five cards. The basic scoring is as follows:

| | |
|---|---|
| Each combination of cards that totals 15 | counts 2 |
| Each pair of cards of the same rank | counts 2 |
| Each combination of three or more in sequence | counts 1 |
| Four cards of the same suit in hand | counts 4 |
| Four cards in hand or crib of same suit as starter | counts 5 |
| His Nobs - jack of same suit as starter in hand or crib | counts 1 |

Each and every card combination of two cards that make a pair, two or more cards that make 15, or three or more cards that make a run, count separately.

The method of playing cribbage according to the present system comprises a live casino card game that uses the scoring method of traditional cribbage to determine hand values without the using the pegging portion of traditional scoring. The present system comprises a method for playing a casino version of the traditional cribbage game. In one aspect of the present system, a method involves counting the four-card hands and one shared upcard or starter card. The hands can then be used for hand-to-hand comparisons between players. In another embodiment, a method is disclosed for odds-based payoffs for total hand count to reward "good" hands.

Definitions

As used in the present patent application, the following words have the following meanings ascribed to them:

"The Count"—The term for totaling hand values.

"Commission"—The percentage charge on winning hands that goes to the house.

"Crib"—The four cards laid away together that belong to the dealer.

"Go"—During the play, one point for the last player to peg under 31.

"His Heels"—If the starter card is any Jack, it counts as two points for the dealer.

"House"—Casino offering and operating the game.

"House Advantage"—The mathematical advantage (in percentage) of the house hand over the player's hand.

"House Banker"—The casino dealer.

"House Rules"—A discard strategy according to a specified set of criteria.

"Lays away"—The term for when the player or the dealer discards one or two cards.

"His Nobs"—If a hand has a jack of the same suit as the starter card, it counts as one point.

"Payoff Chart"—The list of "odds payoffs" for specified hand values.

"The Play"—Counting and pegging points (pairs, 15s, runs and Go's) to 31 between players.

"Player Banker"—Player covering all wagers when not playing against house dealer.

"Pone"—Dealer's opponent.

"Push"—Tie, no win or lose.

"The Show"—Totaling hand values.

"Starter Card"—Shared upcard counted in all hands.

"29 Point Hand"—Best possible traditional hand—includes starter card of a five, three fives in the hand plus the Jack of the same suit as the starter card.

SUMMARY OF THE SYSTEM

The method of playing cribbage according to the presently disclosed system is a new casino, card room or video slot machine card game that uses the scoring method of traditional Cribbage to determine hand values. Traditional Cribbage scores during three portions of the game: the play (pegging), the count or show (totaling hand values), and scoring the Crib hand. As a casino, card room or video slot machine version, the game is shortened to one or two of these three portions in order to offer the efficiency necessary to be played in a casino, card room or video slot machine venue.

The portion of counting the 4-card hands plus one shared upcard (starter card) is the portion of the game that also incorporates the strategy of discarding. This portion may be used for hand-to-hand comparisons between players or to reward the relative strengths of "good" hands with odds based payoffs.

A Crib hand may also be incorporated to create an additional level of excitement with multiple wagers. The age-old appeal of Cribbage can now be offered to multiple players to participate in an abbreviated version of the game in a casino format.

A better understanding of the features and advantages of the present invention will be obtained by reference to the following detailed description of the invention and accompanying drawings which set forth an illustrative embodiment in which the principles of the invention are utilized.

DETAILED DESCRIPTION OF THE DRAWINGS

Those of ordinary skill in the art will realize that the following description of the present invention is illustrative only and not in any way limiting. Other embodiments of the invention will readily suggest themselves to such skilled persons.

This disclosure may relate to data communications. Various disclosed aspects may be embodied in various computer and machine-readable data structures. Furthermore, it is contemplated that data structures embodying the teachings of the disclosure may be transmitted across computer and machine-readable media, and through communications systems by use of standard protocols such as those used to enable the Internet and other computer networking standards.

The disclosure may relate to machine-readable media on which are stored various aspects of the disclosure. It is contemplated that any media suitable for retrieving instructions is within the scope of the present disclosure. By way of example, such media may take the form of magnetic, optical, or semiconductor media, and may be configured to be accessible by a machine as is known in the art.

Various aspects of the disclosure may be described through the use of flowcharts. Often, a single instance of an aspect of the present disclosure may be shown. As is appreciated by those of ordinary skill in the art, however, the protocols, processes, and procedures described herein may be repeated continuously or as often as necessary to satisfy the needs described herein. Accordingly, the representation of various aspects of the present disclosure through the use of flowcharts should not be used to limit the scope of the present disclosure.

Figure 1:
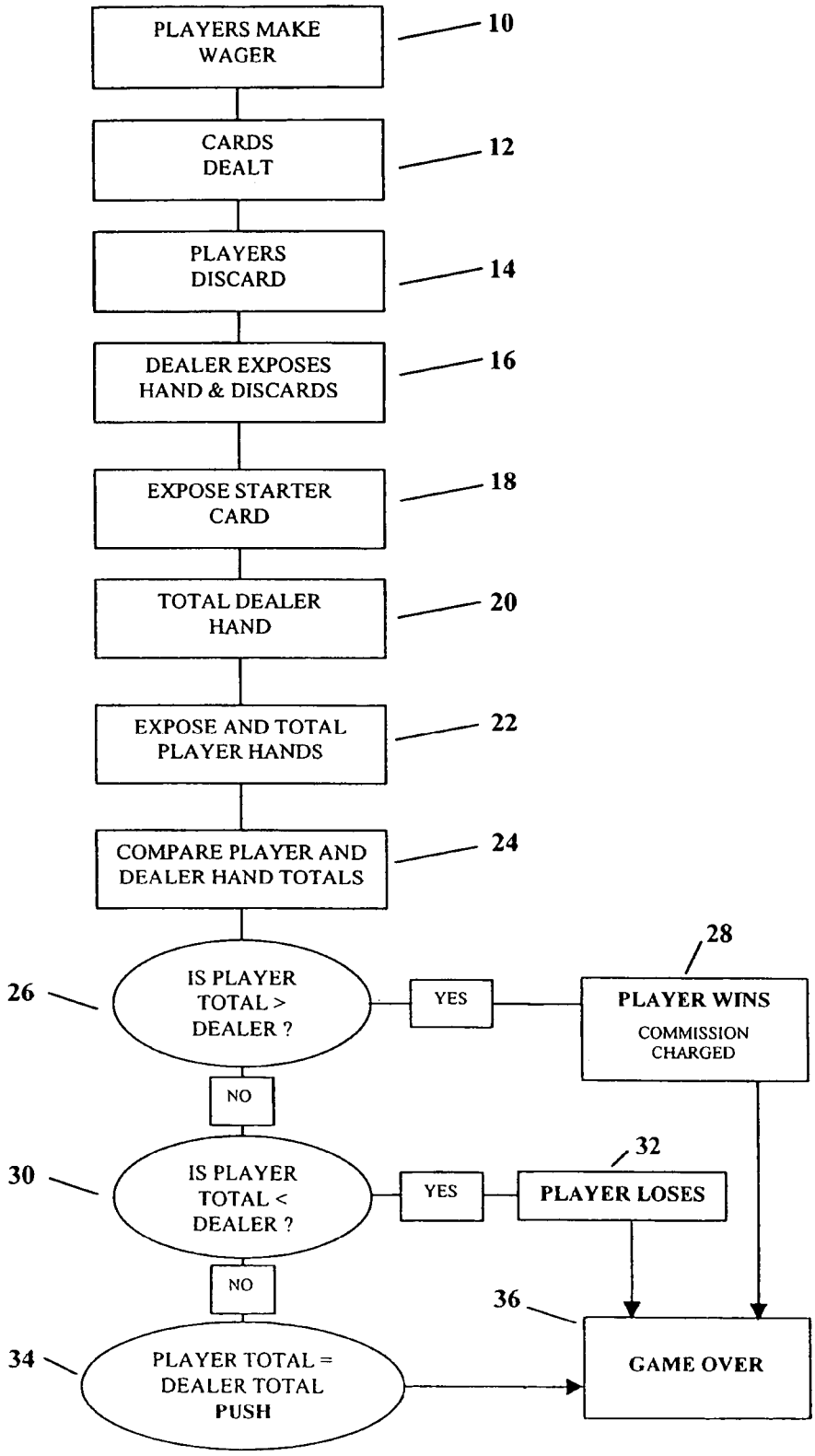
FIG. 1 is a flow chart representation of a cribbage game according to the present system comprising a single wager casino table game version.

FIG. 1 is a flow chart representation of a cribbage game according to the present system comprising a single wager casino table game version. The version of the modified cribbage game of FIG. 1 does not use the traditional cribbage pegboard as set forth in the Background section of this patent application. Additionally, for a one to one payoff, the initial hand must be compared to an independent event to determine whether the bet or wager wins or loses. In keeping with a cribbage format, the comparison used is another cribbage hand. The hand with the higher total points wins. The points are counted using the standard point counting system of conventional Cribbage set forth above. The hand is counted with the starter card to determine total point value of the dealer hand. This creates a comparison of two hands that allow for a one to one payoff for the winning hand.

The game begins at act 10 where the players make the wagers on the game. In this application, "game" as referred to also means the cribbage game according to the disclosed system in its numerous variations. At act 12, five or six cards are dealt to each player depending on the version used. Next, at act 14, the players discard either one or two cards, again depending on the version.

At act 16, the dealer exposes his or her hand and discards one or two cards. Next, the starter card is exposed at act 18. At act 20, the dealer's hand is totaled. Next, at act 22, the players' hands are exposed and totaled. Next, the player's hand is compared to the dealer's hand at act 24. At query 26, it is determined whether the player's hand has a higher point value than the dealer's hand. If the player's hand has a higher point value than the dealer's hand, the player wins and a commission is charged from the player's winnings at act 28. If the answer is no, at query 30, it is determined whether the player's hand has a lower point value than the dealer's hand. If the player's hand has a lower point value than the dealer's hand then the player loses at act 32. If the answer is no, at act 34 the player point total is equal to the dealer point total and there are no wins. At act 36, the game is over.

Figure 2:
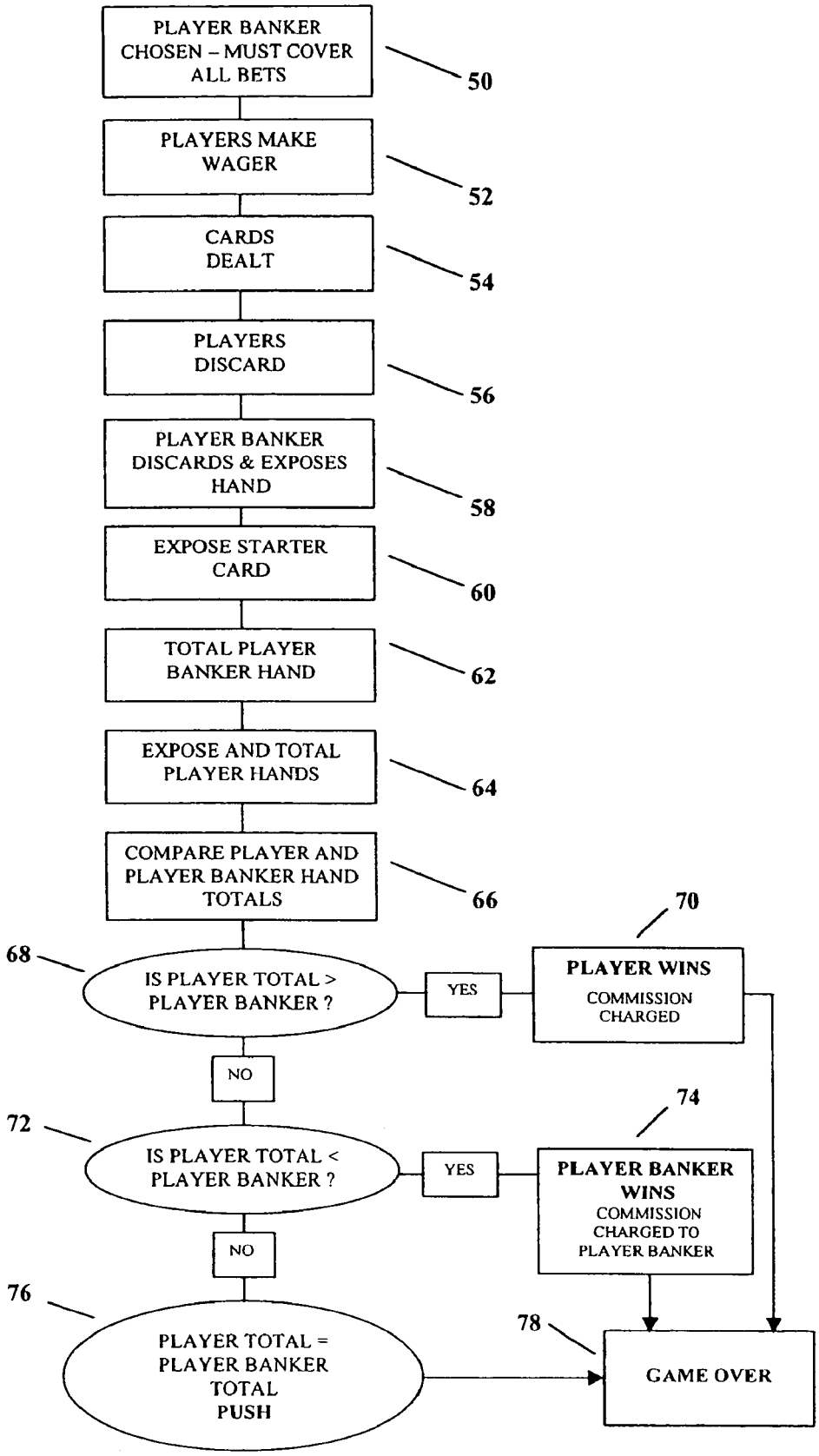
FIG. 2 is a flow chart representation of a cribbage game according to the present system comprising a single wager card room version with a rotating player banker.

FIG. 2 is a flow chart representation of a card room version of a cribbage game according to the present system comprising a single wager card room version with a rotating player banker. The game begins at act 50. At act 50, a player banker is chosen. The player banker must be able to cover all bets. Also, a different player banker may be chosen for each game. Next, the players make wages at act 52. At act 54, six cards are dealt to each player. Next, the players discard two cards at act 56. At act 58, the player banker discards two cards and exposes his or her hand. Next, the starter card is exposed at act 60. At act 62, the player banker's hand is totaled. Next, the players' hands are exposed and totaled at act 64. At act 66, the player banker's hand is compared to the players' hand. At query 68 it is determined whether the player's hand has a higher point value than the player banker's hand. If the player's hand has a higher point value than the player banker's hand then the player wins and a commission is charged to player at act 70. At query 72 it is determined whether the player's hand has a lower point value than the player banker's hand. If the player's hand has a lower point value than the player banker's hand then the player banker wins and commission is charged to the player banker at act 74. If the players' hand is equal to the player banker's hand then it is a push and there are no wins at act 76. Finally, the game ends at act 78.

Figure 3:
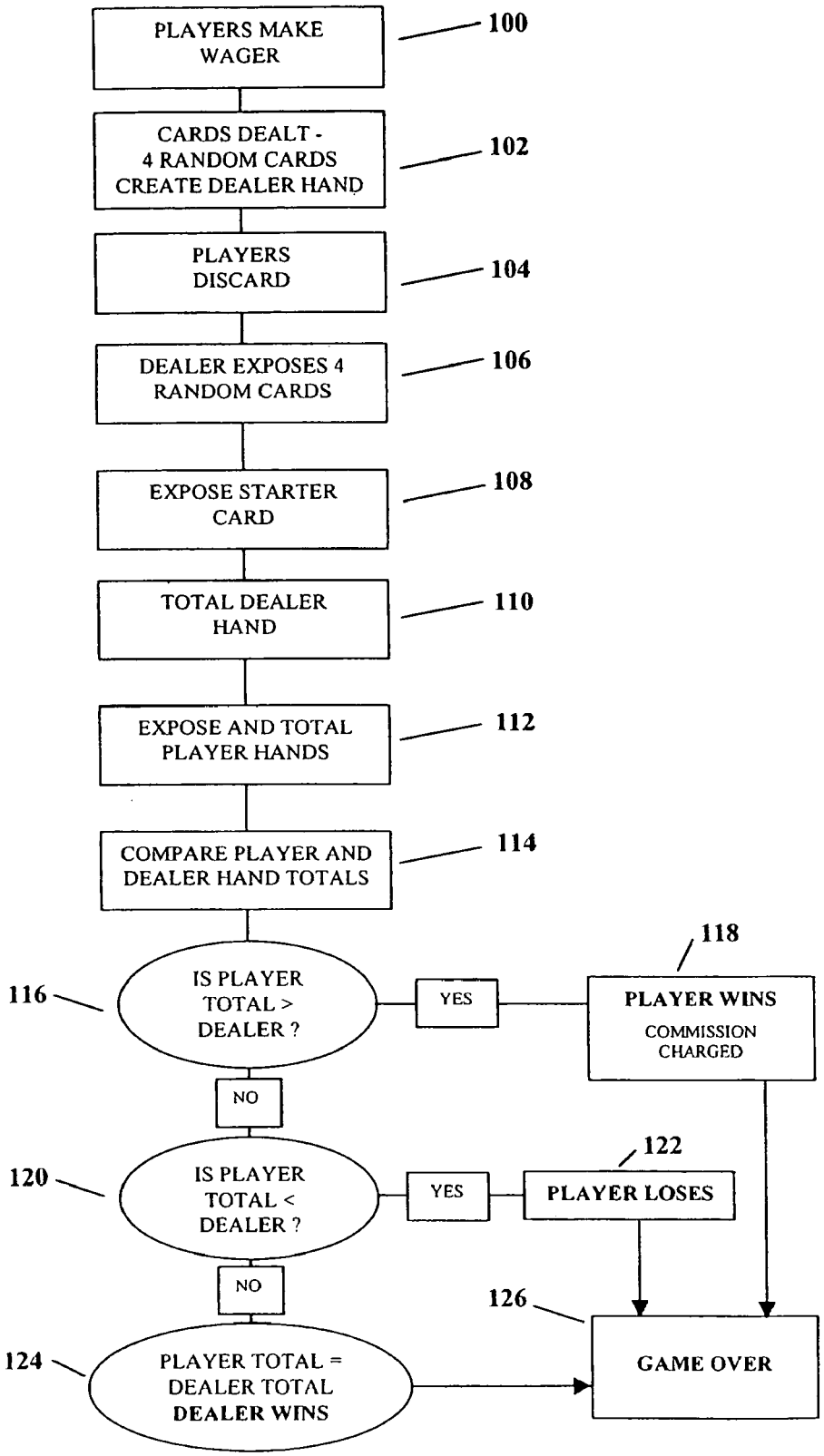
FIG. 3 is a flow chart representation of a cribbage game according to the present system comprising a single wager with a four random card dealer hand.

FIG. 3 is a flow chart representation of a cribbage game according to the present system comprising a single wager with a four random card dealer hand. In a casino, when a new game is created, House Rules must be created and taught for the new game. As an alternate to having to create and teach House Rules, the dealer can receive four random cards with no discard decisions. In order to offset the mathematical disadvantage of having no discard, the dealer could win pushing totals. As an alternate or additional factor to balance the mathematical disadvantage of having no discard, "His Nobs" can be included to add two points to the dealer's hand when a jack is exposed as a starter card. FIG. 3 represents this embodiment of the presently disclosed system.

The game begins at act 100 where the player makes a wager. Next, the player is dealt a plurality of cards and four random cards are dealt to form the dealer hand at act 102. At act 104, the player discards two cards. Next, the dealer exposes his or her four card random hand at act 106. At act 108, the starter card is exposed. As set forth above, in one embodiment, if the starter card is a jack, then the dealer adds two points to his hand total. Next, at act 110, the dealer totals his hand with the starter card. At act 112, the player hands are exposed and totaled. Next, at act 114, the point value of the player hands and the dealer hand are totaled. At query 116, it is determined whether the player's hand has a higher point value than the dealer's hand. If the player's hand has a higher point value than the dealer's hand, the player wins at act 118. If the answer is no, at query 120 it is determined whether the player's hand has a lower point value than the dealer's hand. If the player's hand has a lower point value than the dealer's hand then the player loses at act 122. If the answer is no, at act 124 the player point total is equal to the dealer point total and the dealer wins pushes. At act 126, the game is over.

Figure 4:
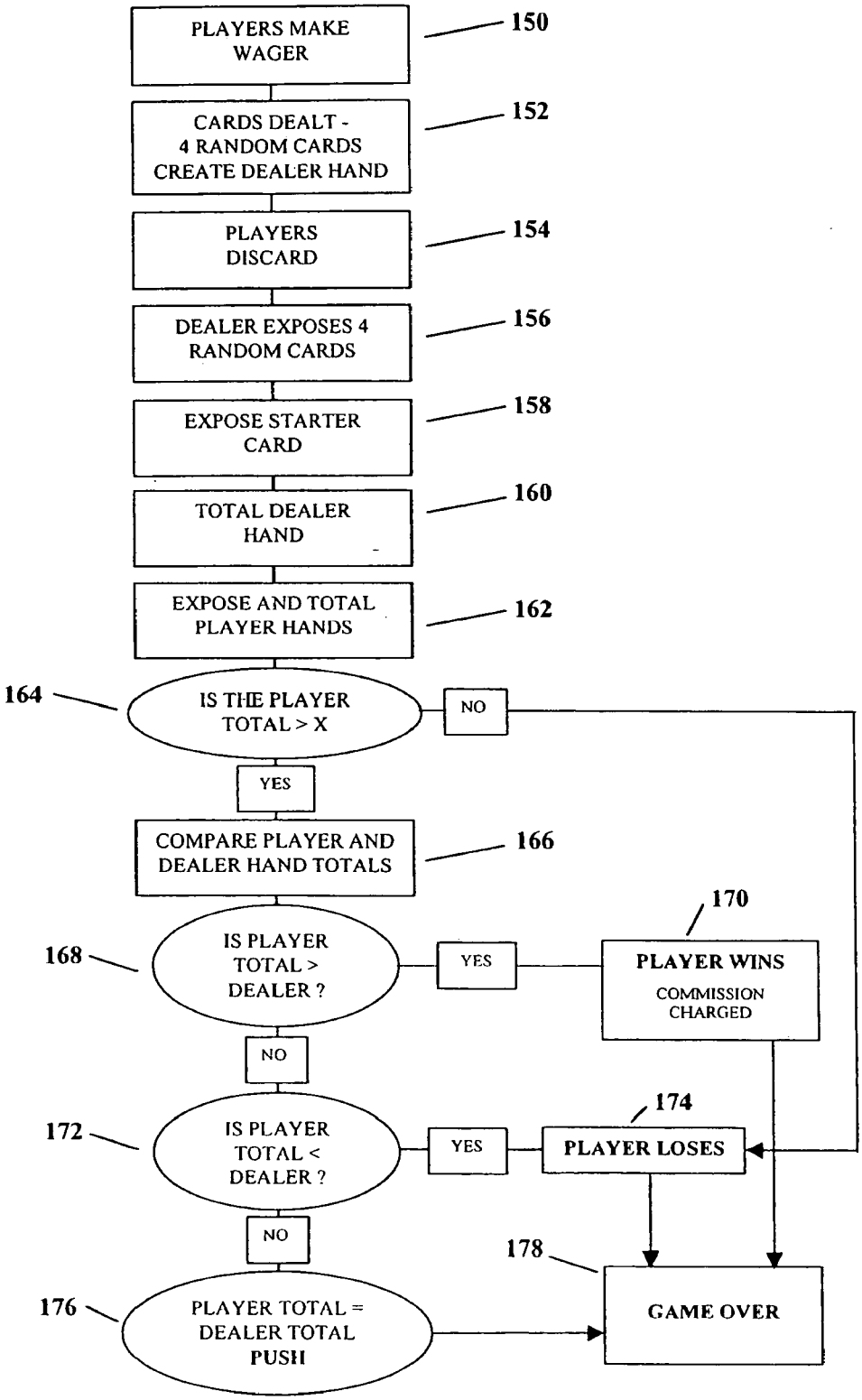
FIG. 4 is a flow chart representation of a cribbage game according to the present system comprising another embodiment of a single wager with a four random card dealer hand.

FIG. 4 is a flow chart representation of a cribbage game according to the present system comprising another embodiment of a single wager with a four random card dealer hand. The game begins at act 150 where the player makes a wager. Next, the player is dealt a plurality of cards and four random cards are dealt to form the dealer hand at act 152. At act 154, the player discards two cards. Next, the dealer exposes his or her four card random hand at act 156. At act 158, the starter card is exposed. As set forth above, in one embodiment, if the starter card is a jack, then the dealer adds two points to his hand total. Next, at act 160, the dealer totals his hand with the starter card. At act 162, the player hands are exposed and totaled. Next, at query 164, the players' hands are compared to a qualifying total, X, to determine if the total value of the player hand is greater or less than X. If the player's total point value of his or her hand is below X, the player loses at act 174. If the total value of the player's hand is greater than X, the point value of the player hands and the dealer hand are compared at act 166. At query 168, it is determined whether the player's hand has a higher point value than the dealer's hand. If the player's hand has a higher point value than the dealer's hand, the player wins at act 170. If the answer is no, at query 172, it is determined whether the player's hand has a lower point value than the dealer's hand. If the player's hand has a lower point value than the dealer's hand then the player loses at act 174. If the answer is no, at act 176, the player point total is equal to the dealer point total no one wins. At act 178 the game is over.

Figure 5A:
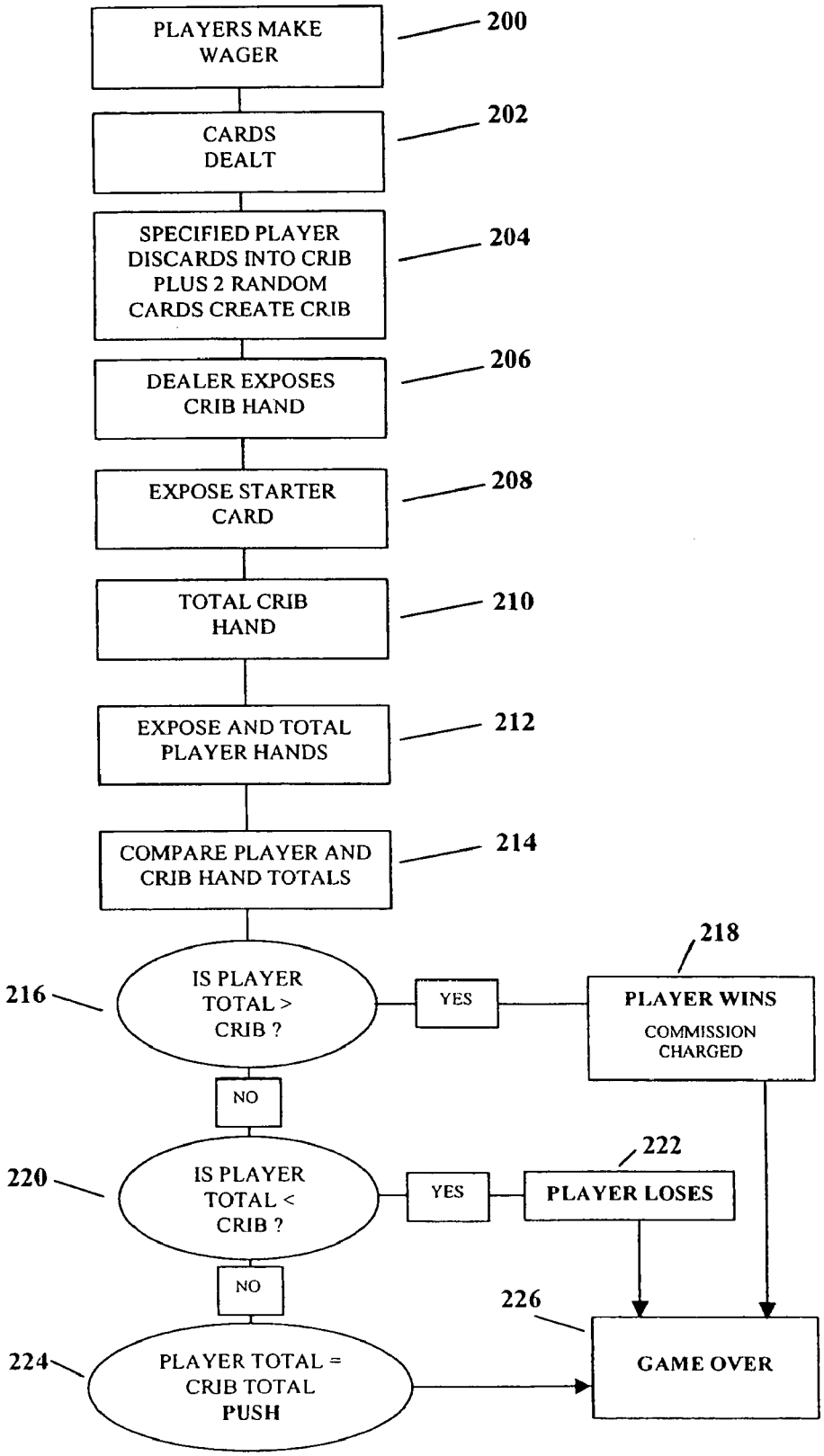
FIG. 5*a* is a flow chart representation of a cribbage game according to the present system comprising a method of playing against the crib hand.

FIG. 5*a* is a flow chart representation of a cribbage game according to the present system comprising a method of playing against the crib hand. Conventional crib hands are created through discarding by the player and can be either offensive or defensive in manner. Offensive discarding meaning that the player discards into their own crib and tries to maximize their crib points as well as their hand points. Defensive discarding meaning that an opposing player holds the crib and the discard into the crib would be the least possible combination of cards while still maximizing their own hand.

Referring still to FIG. 5*a*, the game begins when the player makes a wager at act 200. Next, six cards are dealt to each player at act 202. At act 204, the players discard two cards and a specified player discards his or her two cards into the crib hand. Two random cards are also selected for the crib hand at act 204. At act 206, the dealer exposes the crib hand. At act 208, the dealer exposes the starter card. Next, the crib hand is totaled at act 210. At act 212, the player hands are exposed and totaled. At act 214, the player and crib hand totals are compared. At query 216, it is determined whether the player hand total point value is greater than the crib hand total point value. If the player hand total point value is greater than the crib hand total point value, the player wins and a commission is paid at act 218. At query 220, it is determined if the player hand total point value is less than the crib hand total point value. If the player hand total point value is less than the crib hand total point value, then the player loses at act 222. Next, at act 224, the crib hand value is equal to the player hand value and it is a push. At act 226, the game is over.

Figure 5B:
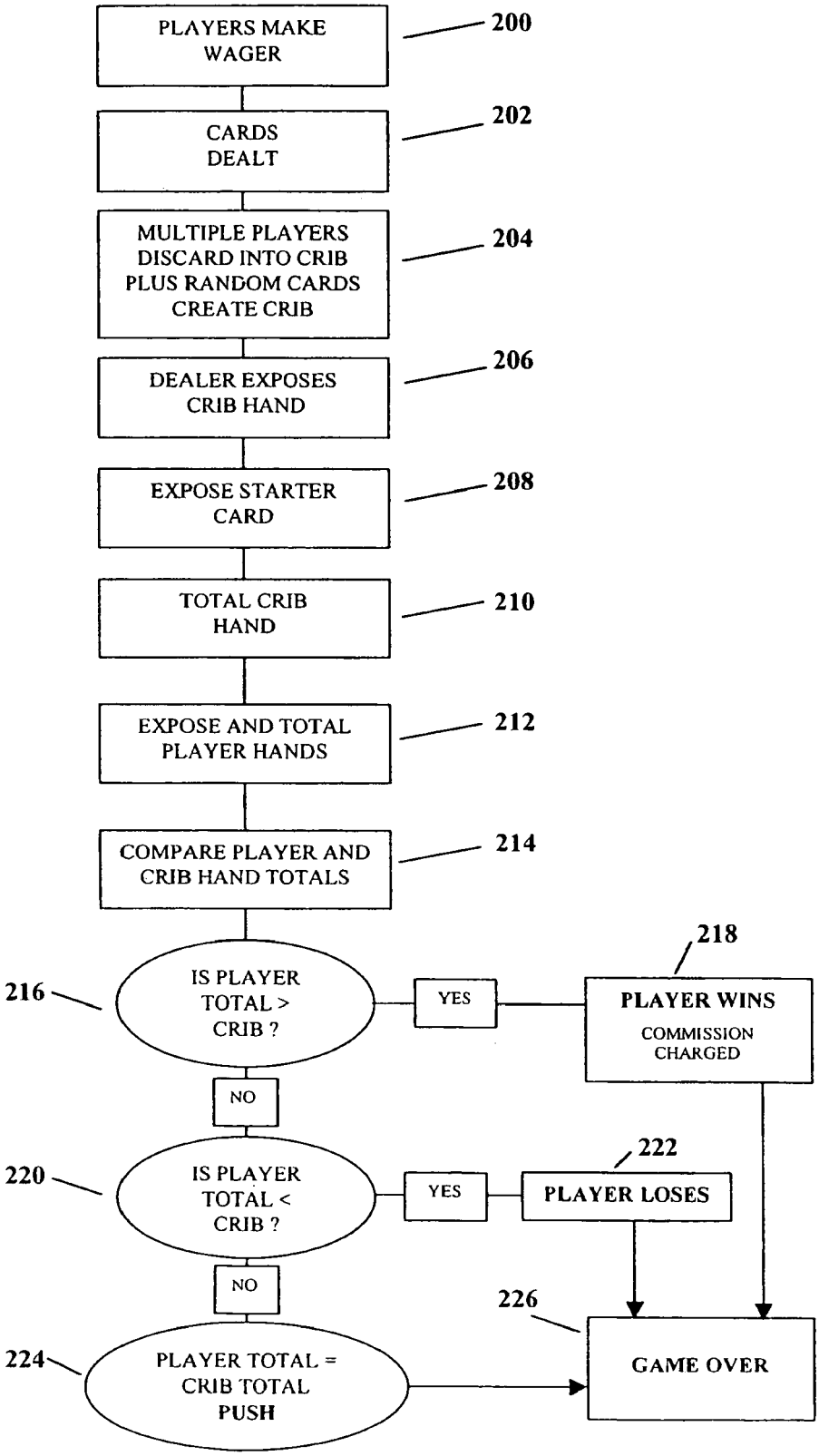
FIG. 5*b* is another flow chart representation of a cribbage game according to the present system comprising another method of playing against the crib hand.

FIG. 5*b* is another flow chart representation of another embodiment of the cribbage game according to FIG. 5*a* of the present system. As shown in FIG. 5*b*, only act 204 has changed from FIG. 5*a*. In this embodiment, at act 204, multiple players discard to form the crib hand plus random cards if necessary.

Figure 5C:
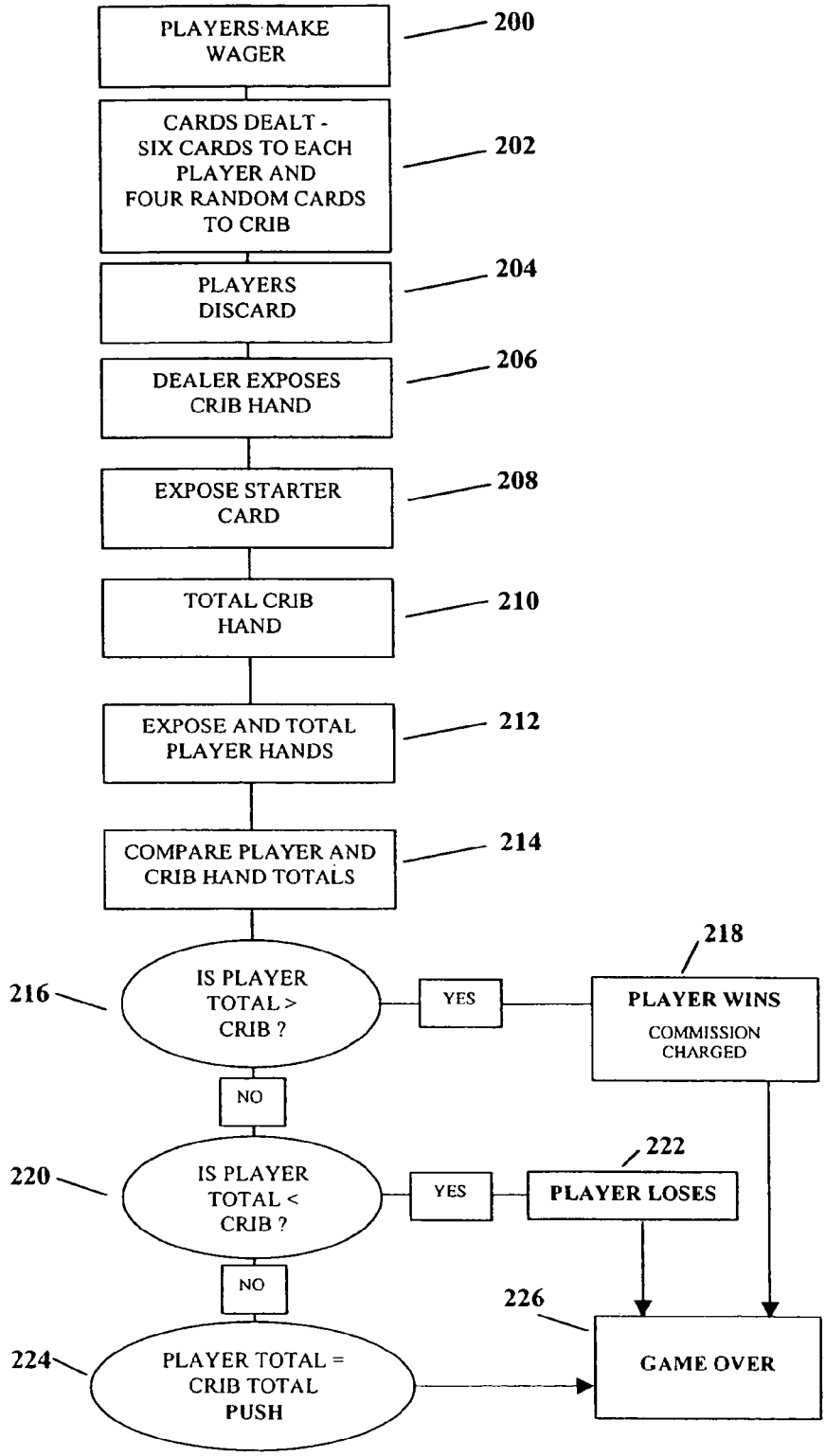
FIG. 5*c* is a flow chart representation of a cribbage game according to the present system comprising yet another method of playing against the crib hand.

FIG. 5*c* is a flow chart representation of yet another embodiment of the cribbage game according to FIG. 5*a* the present system. As shown in FIG. 5*c*, only act 202 has changed from FIG. 5*a*. In this embodiment, at act 202 six cards are dealt to each player and four random cards are dealt to the crib hand.

Figure 6:
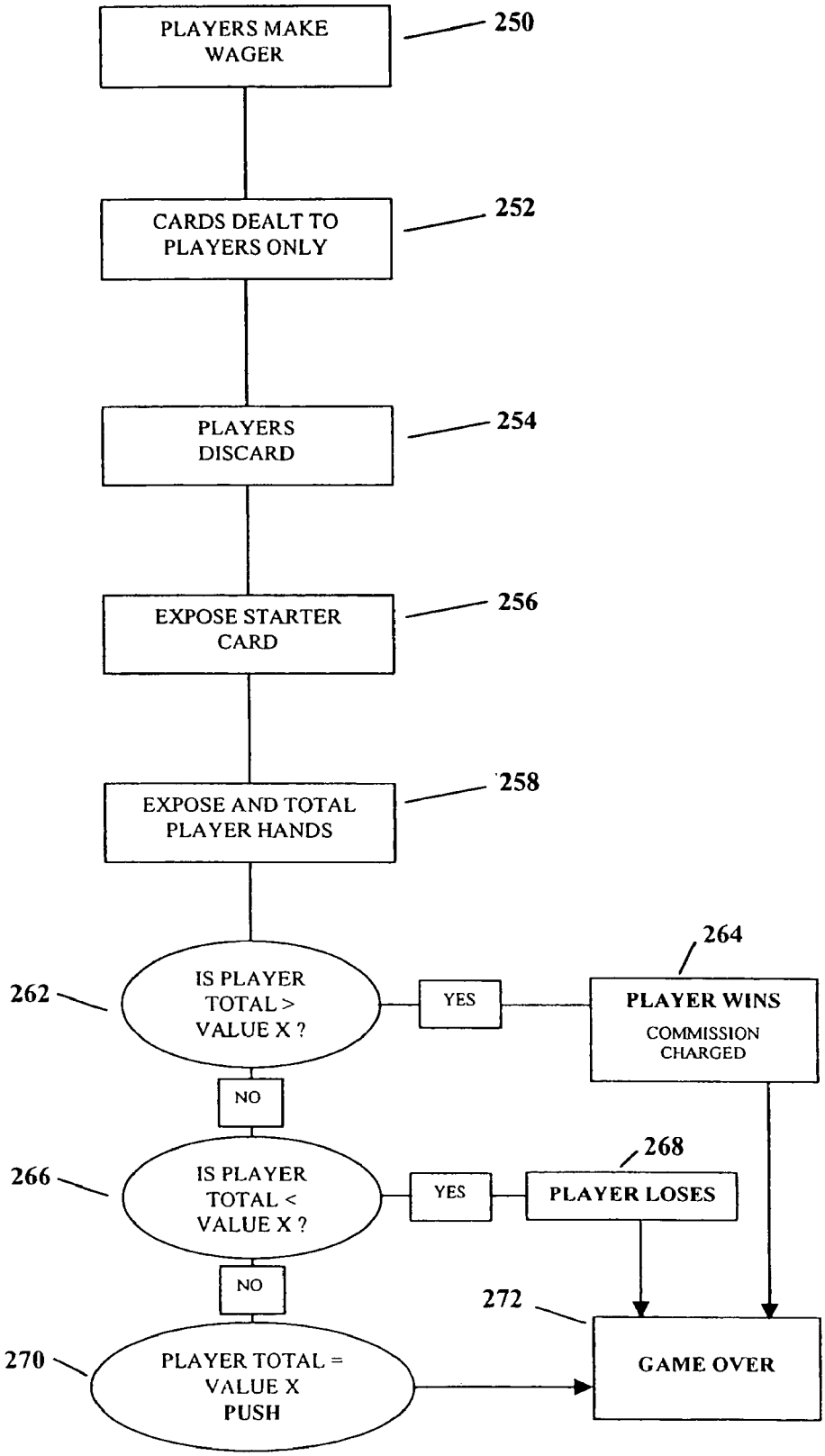
FIG. 6 is a flow chart representation of a cribbage game according to the present system comprising a method of playing cribbage with a fixed point comparison.

FIG. 6 is a flow chart representation of a cribbage game according to the present system comprising a method of playing cribbage with a fixed-point comparison. In this embodiment, a predetermined point value is chosen for comparison with a player's hand. Having a fixed-point value for players to compare to creates an efficient game. The players win their bet if they exceed a specific, predetermined point value.

The game begins at act 250 when the player makes a wager. Next, six cards are dealt to each player at act 252. At act 254, the players discard two cards. Next, at act 256, the starter card is exposed. At act 258, the players' hands are exposed and totaled. Next, the player hand totals are compared to fixed point value, X. At query 262, it is determined whether the player hand total point value is greater than X. If the player hand total point value is greater than X, the player wins and a commission is paid at act 264. At query 266, it is determined if the player hand total point value is less than X. If the player hand total point value is less than X, then the player loses at act 268. Next, at act 270, the crib hand value is equal to the player hand value and it is a push. At act 272, the game is over.

Figure 7:
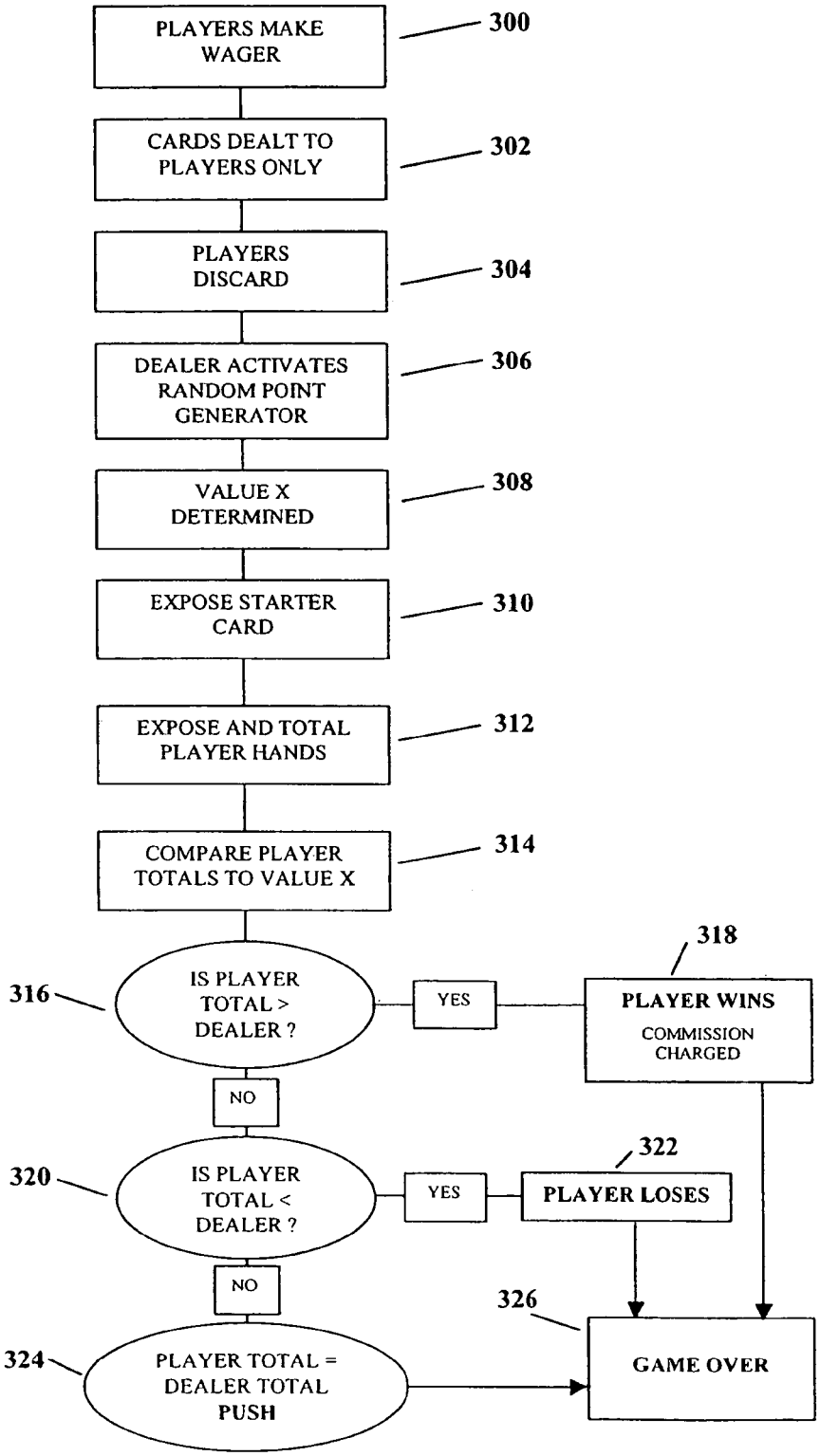
FIG. 7 is a flow chart representation of a cribbage game according to the present system comprising a method of playing cribbage with a variable point comparison.

FIG. 7 is a flow chart representation of yet another embodiment of a method of playing a cribbage game according to the present system comprising a method of playing cribbage with a variable point comparison. The game begins at act 300 when the player makes a wager. At act 302, six cards are dealt to the players. Next, at act 304, the players discard two cards. At act 306, the dealer activates the random point generator. Next, point value X is generated at act 308. At act 310, the starter card is exposed. Next, the player hands are exposed and totaled at act 312. At act 314, the player hands are compared to point value X. At query 316, it is determined whether the player hand total point value is greater than X. If the player hand total point value is greater than X, then the player wins and a commission is charged at act 318. If the player hand total point value is not greater than X, at query 320 it is determined whether the player hand total point value is less than X. If the player hand value is less than X, the player loses at act 322. If the player hand total point value is equal to X, there is a push at act 324 and the game ends at act 326.

Figure 8:
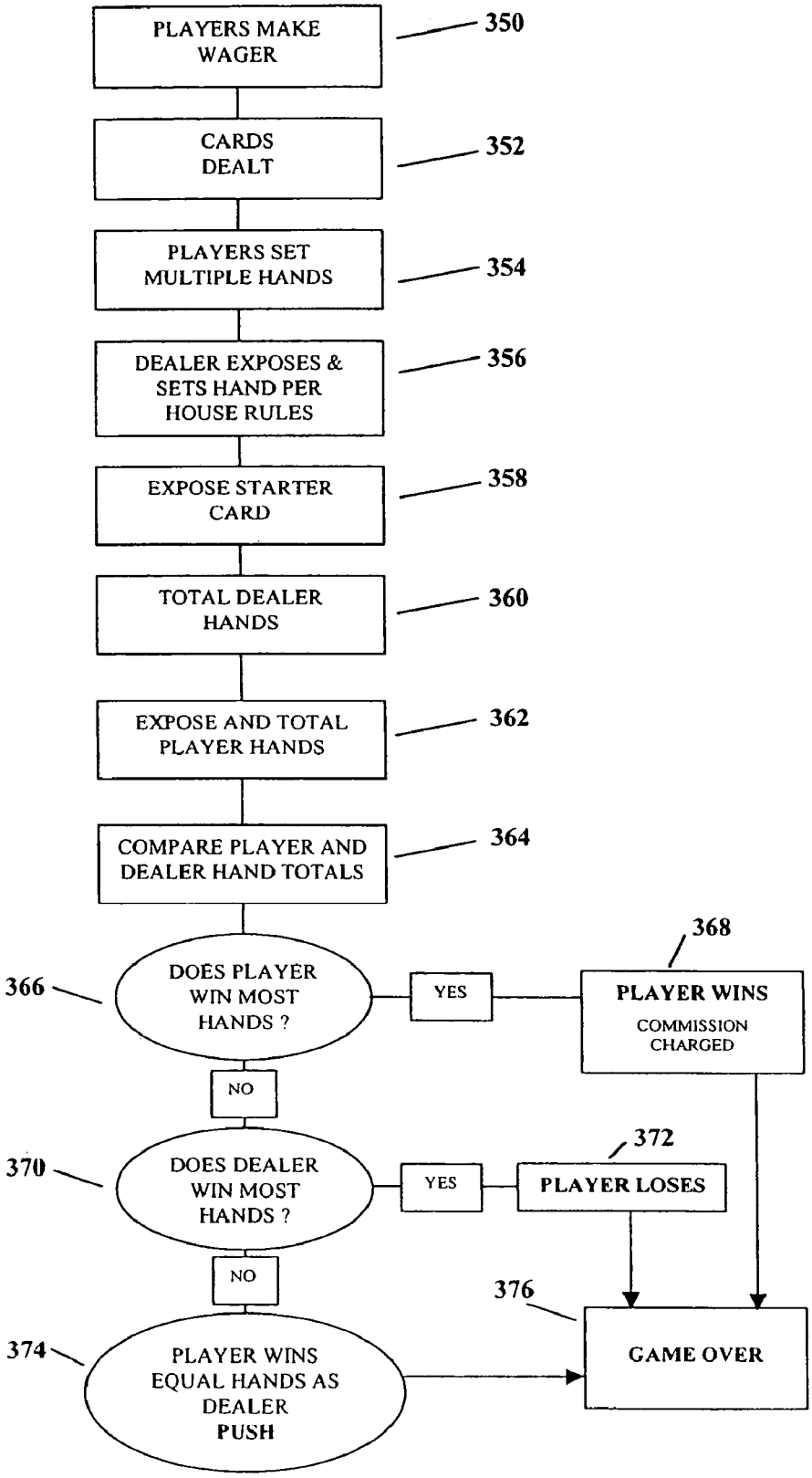
FIG. 8 is a flow chart representation of a cribbage game according to the present system comprising a method of playing cribbage having a double or multiple hand game.

FIG. 8 is a flow chart representation of yet another embodiment of a cribbage game according to the present system comprising a method of playing cribbage having a double or multiple hand game. The game begins at act 350 when the player makes a wager. At act 352, the cards are dealt. At act 354, the player sets his hands. In this embodiment of the game, a multiple hand game is played and the overall result is determined by the win/loss combination of two or more hands. An individual hand may be comprised of full hands, "short" hands with less than four cards plus a starter card or combinations of both depending on house rules. Next, the dealer exposes her or her cards and sets hand per house rules at act 356. At act 358, the starter card is exposed. Next, the dealer hands are totaled at act 360. At act 362, the player hands are exposed and totaled. At act 364, the player hands are compared to the dealer hands. At query 366, it is determined whether the player wins more of the hands than the dealer. If the player wins more of the hands than the dealer, the player wins and a commission is charged at act 368. At query 370, it is determined whether the dealer wins more of the hands than the player. If the dealer wins more of the hands than the player, the player loses at act 372. If the player and dealer win an equal number of hands, the game is a push at act 374. The game ends at act 376.

Figure 9:
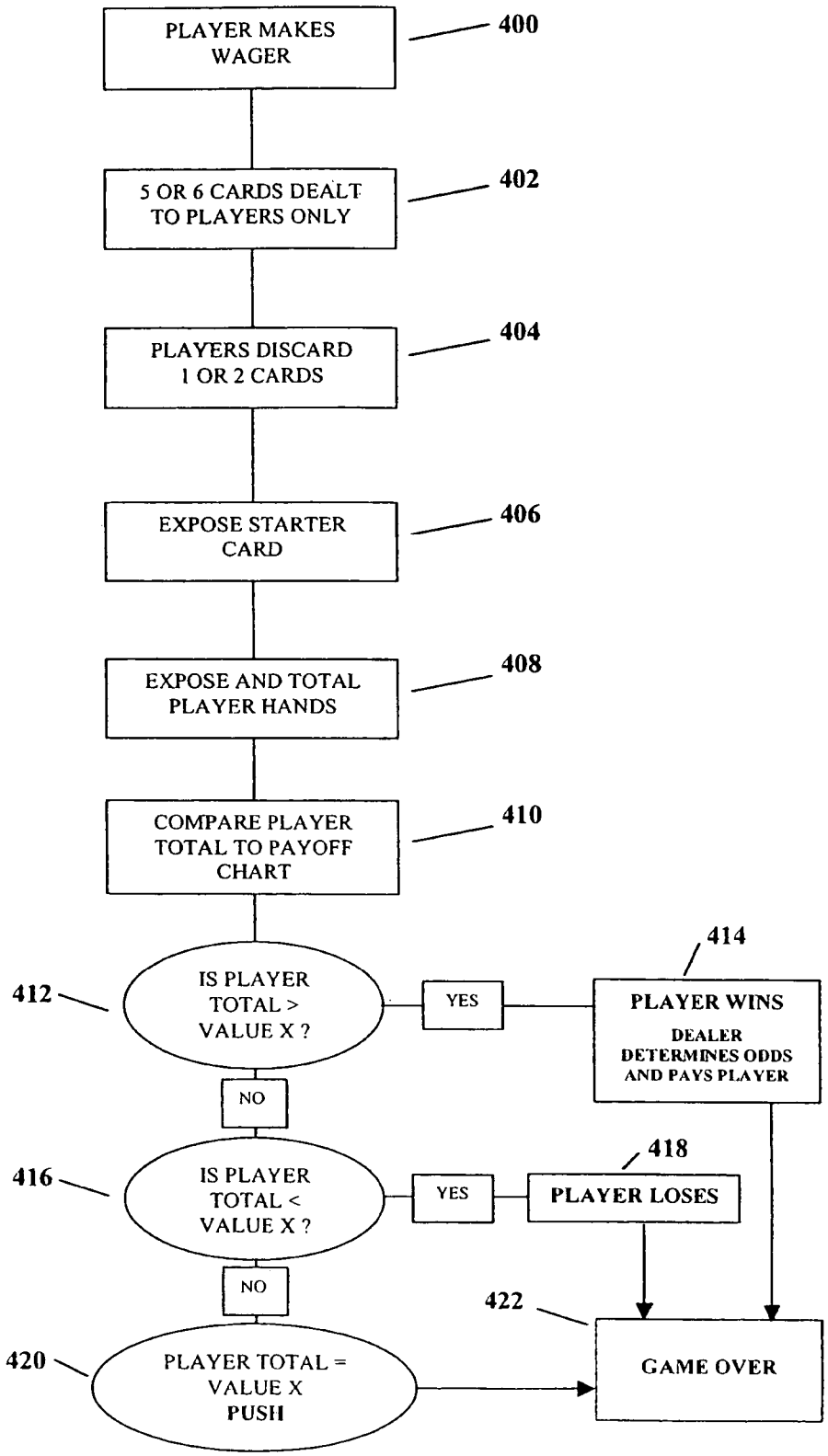
FIG. 9 is a flow chart representation of a cribbage game according to the present system comprising a single wager game with a payoff schedule.

FIG. 9 is a flow chart representation of yet another embodiment of a cribbage game according to the present system comprising a single wager game with a payoff schedule. In this embodiment of the game, there is a chance of receiving a large jackpot for the 29-point maximum hand.

By utilizing the point system of traditional cribbage, a casino style version table game can be played. Play is against the house without the house playing a hand. Odds based payoffs begin at a qualifying level and are increased in increments to the highest payoff for a 29-point hand.

Using a casino style table game with a house dealer, each player would receive 5 cards and one "common card" (starter) would be placed in the center of the table face down. Each player would then discard 1 card retaining the best 4 cards that the player believes will yield the greatest point value after the shared upcard has been exposed.

After each player discards one card, the dealer exposes the upcard. Each player hand is then exposed and the dealer determines the total point value of the player's four cards along with the shared upcard. Once the dealer determines the player's hand point total, each player's wager is taken, pushed or paid according to a payoff chart. Odds begin at (for example) 8 points and increase each level with higher payoffs until the maximum hand of 29 points is reached. Player's hands with less than 8 points would lose to the house.

With no possible totals of 19, 25, 26, or 27, an example payoff chart is:

| | |
|---|---|
| 8 points | 1 to 1 |
| 9 to 10 points | 3 to 1 |
| 11 to 13 points | 5 to 1 |
| 14 to 16 points | 10 to 1 |
| 17 to 20 points | 25 to 1 |
| 21 to 22 points | 50 to 1 |
| 23 to 24 points | 100 to 1 |
| 28 points | 500 to 1 (or % of Jackpot) |
| 29 points | 1,000 to 1 (or Jackpot) |

Six Card Variation:

The previous method is based on the traditional three or four person Cribbage game where players are dealt 5 cards and discard 1 into the crib. The second variation would be where 6 cards are dealt to the players and 2 are discarded (based on two-handed Cribbage).

This would involve more discard strategy and the payoff chart would need to be modified to reflect the different odds. This version would may also be appropriate to the video slot version, as it would allow the player to make small wagers with large potential payoffs.

Still referring to FIG. 9, in this embodiment, the game begins at act 400 when the player makes a wager. Next, five or six cards are dealt to the player only at act 402. At act 404, the players discard 1 or 2 cards depending on how many are dealt to each player. At act 406, the starter card is exposed. Next, the player hands are exposed and point values totaled at act 408. At act 410, the player hand total point values are compared to the payoff chart. At query 412, it is determined whether the player hand total point value is greater than X value on the payoff chart. If the player hand total point value is greater than X, the dealer determines the odds and pays the player at act 414. At query 416, it is determined whether the player hand total point value is less than X value on the payoff chart. If the player hand point value is less than X, the player loses at act 418. If the player point value is equal to X there is a push at act 420. The game ends at act 422.

Figure 10:
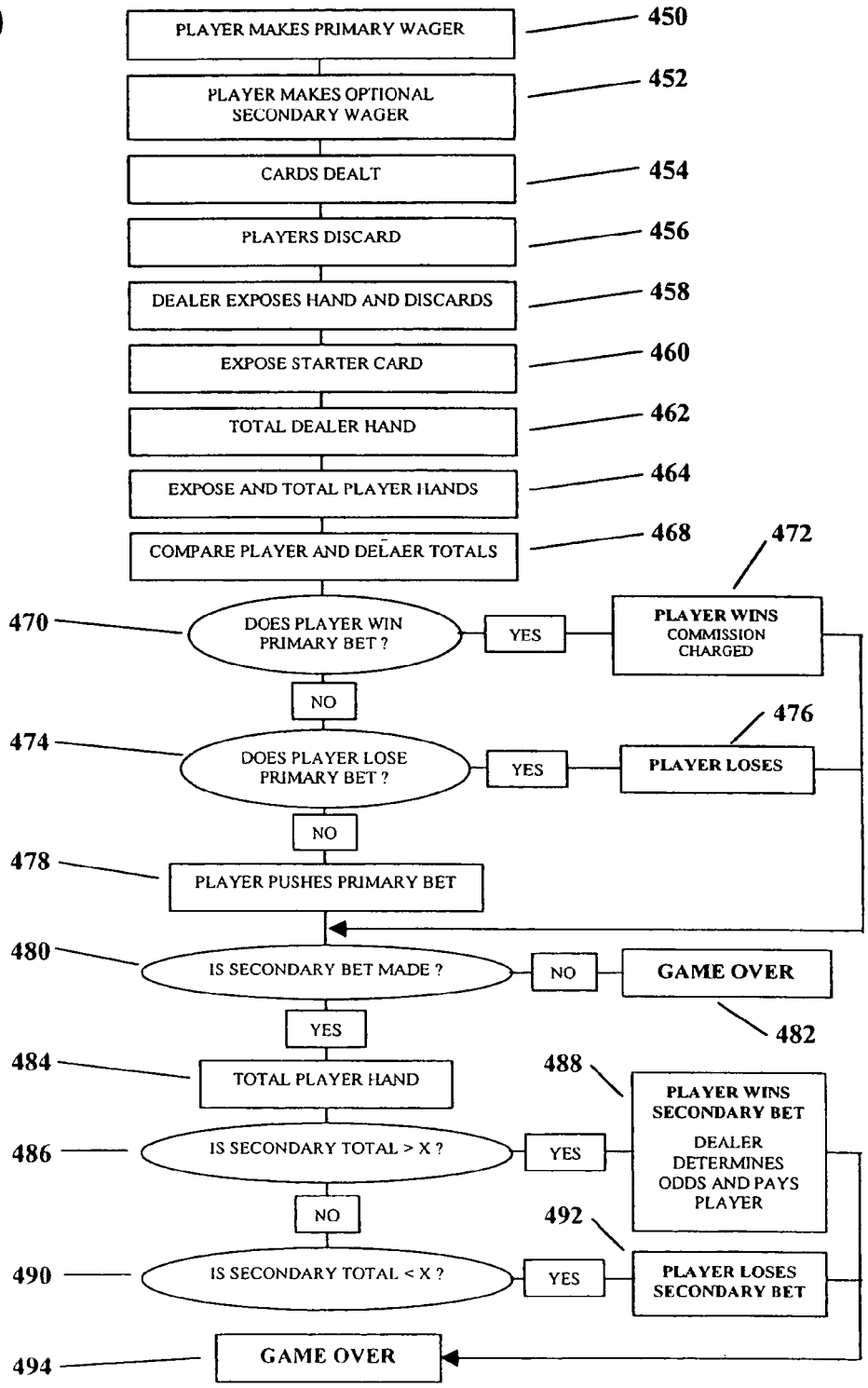
FIG. 10 is a flow chart representation of a cribbage game according to the present system comprising a multiple wager game with a payoff schedule.

FIG. 10 is a flow chart representation of yet another embodiment of a cribbage game according to the present system comprising a multiple wager game with a payoff schedule. The gamer begins at act 450 when the players make a primary wager. Next, at act 452 the player may make a secondary wager. At act 454, the cards are dealt. At act 456, the players discard. Next, the dealer exposes his or her hand and discards at act 458. At act 460, the dealer exposes the starter card. The dealer hand is totaled at act 462 and at act 464 the player hands are totaled. Next, the player hand total point value is compared to the dealer hand total hand point value at act 468. At query 470, it is determined whether the player hand total point value is greater than the dealer hand total point value. If the player hand total point value is greater than the dealer hand total point value the player wins the primary bet and a commission is paid at act 472. If the player hand total point value is not greater than the dealer hand total point value, it is determined at query 474 whether the player hand total point value is less than the dealer hand total point value. If the player hand total point value is less than the dealer hand total point value, the player loses at act 476. Next, at act 478, the player hand total point value equals the dealer hand total point value and there is a push of the primary bet. At query 480, it is determined whether the player, whether they won the primary bet at act 472 or lost the primary bet at act 476 or pushed the primary bet at act 478, made a secondary wager. If the player did not make a secondary wager, the game is over at act 482. If the player did make a secondary wager, at act 484, the player hand total point value is determined. Next, it is determined whether the player hand total point value is greater than X at query 486. If the player hand total point value is greater than X, the player wins the secondary wager and the dealer determines the odds and pays the player based on the payoff chart at act 488. Next, it is determined whether the player hand total point value is less than X at query 490. If the player hand total point value is less than X, the player loses the secondary wager at act 492. The game is over at act 494.

Figure 11:
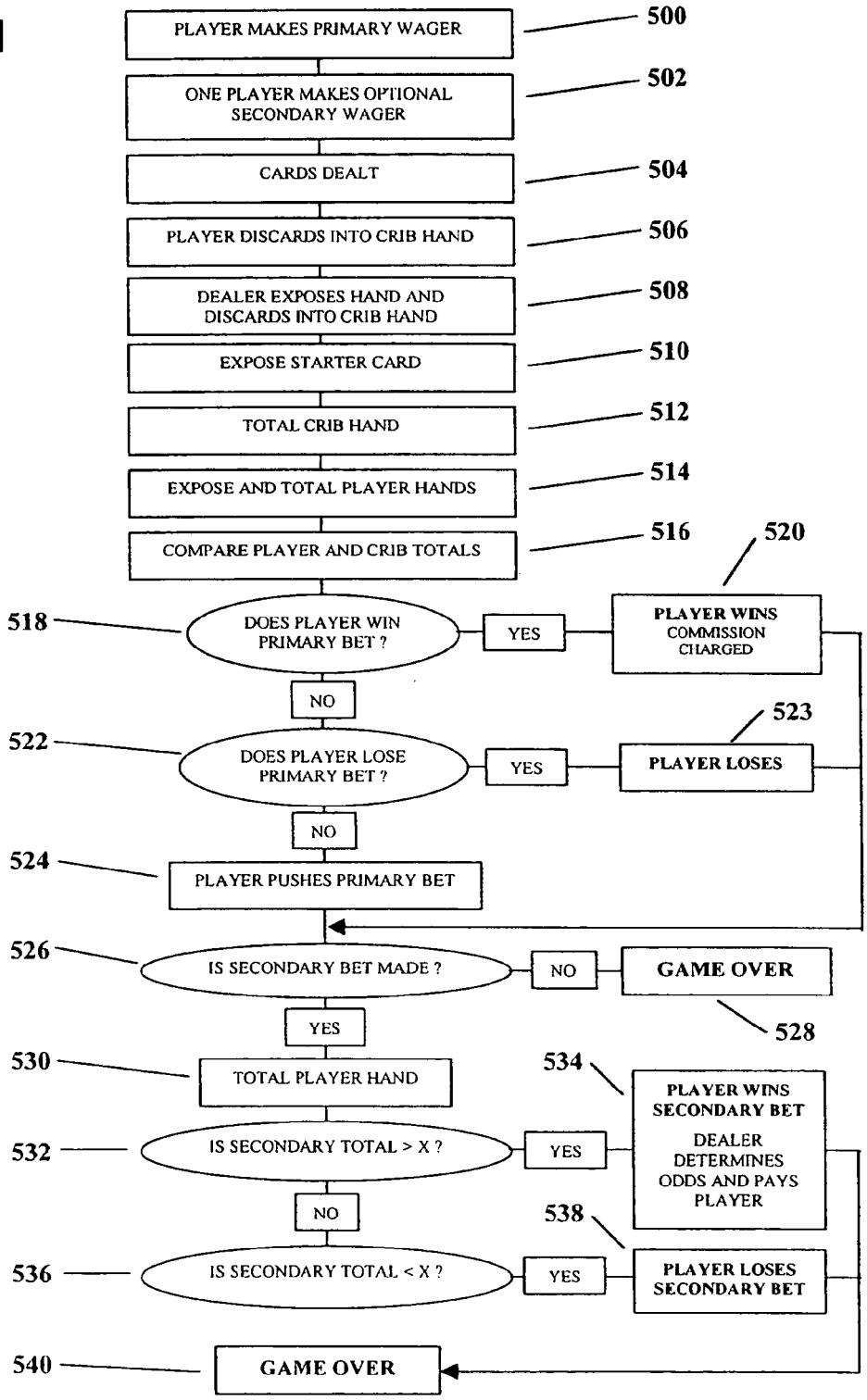
FIG. 11 is a flow chart representation of a cribbage game according to the present system having a crib hand and a single player.

FIG. 11 is a flow chart representation of yet another embodiment of a cribbage game according to the present system having a crib hand and a single player with a secondary wager on the player's total. At act 500, the game begins when the players make the primary wager. At act 502, the player may make a secondary wager. Next, six cards are dealt to the player and dealer at act 504. At act 506, the player discards two cards into the crib hand. Next, the dealer exposes his hand and discards two cards into and completing the crib hand at act 508. At act 510, the starter card is exposed. At act 512, the crib hand total point value is determined. Next, the player hand is exposed and the player hand total point value is determined at act 514. At act 516, the player hand total point value is compared to the crib hand total point value. At query 518, it is determined whether player hand total point value is greater than the dealer hand total point value. If the player hand total point value is greater than the dealer hand total point value the player wins the primary wager and pays a commission at act 520. At query 522, it is determined if the player hand total point value is less than the dealer hand total point value. If it is determined if the player hand total point value is less than the dealer hand total point value, the player loses the primary wager at act 523 and proceeds to query 526. If the player hand total point value is equal to the dealer hand total point value, the player pushes the primary bet. At query 526, it is determined whether the player made a secondary wager. If the player did not make a secondary wager, the game is over at act 540. If the player did make a secondary wager, the player hand is exposed and totaled at act 530. At query 532, it is determined whether the player hand total point value is greater than X. If it is determined if the player hand total point value is greater than X, then the player wins the secondary wager and the dealer determines odds and pays the player based on the payoff chart at act 534. At query 536, it is determined whether the player hand total point value is less than X. If it is determined if the player hand total point value is less than X, then the player loses the secondary wager at act 538. The game is over at act 540.

In the above embodiment, before the beginning of each round, one player will have the opportunity to play a Crib hand on a rotational basis. The dealer offers the Crib to each player in turn until it is either played by one person or passed by all players and the hand is not played. If a player opts to take the Crib, they would make an additional wager up to the amount of their original bet. The use of a marker could be implemented to keep track of whose turn it is to take the Crib, and to secure discards into the Crib.

After all players have received their cards, the dealer will then deal the starter card face down and then deal two cards to the Crib hand. Each player discards two cards, however the player betting on the Crib hand will discard his two cards into the Crib hand, adding them to the two cards by the dealer, creating a four card Crib hand.

Play continues as normal with the Crib player showing their hand last. After determining all hands, the Crib hand is then played, and paid or taken based on either the regular payoff chart or one specifically for the Crib.

In yet another embodiment, a five-card version would be a simple modification with the discard of only one card during play and the dealer adds three cards to the Crib. This would be a higher house advantage game with less strategy for the player.

Figure 12:
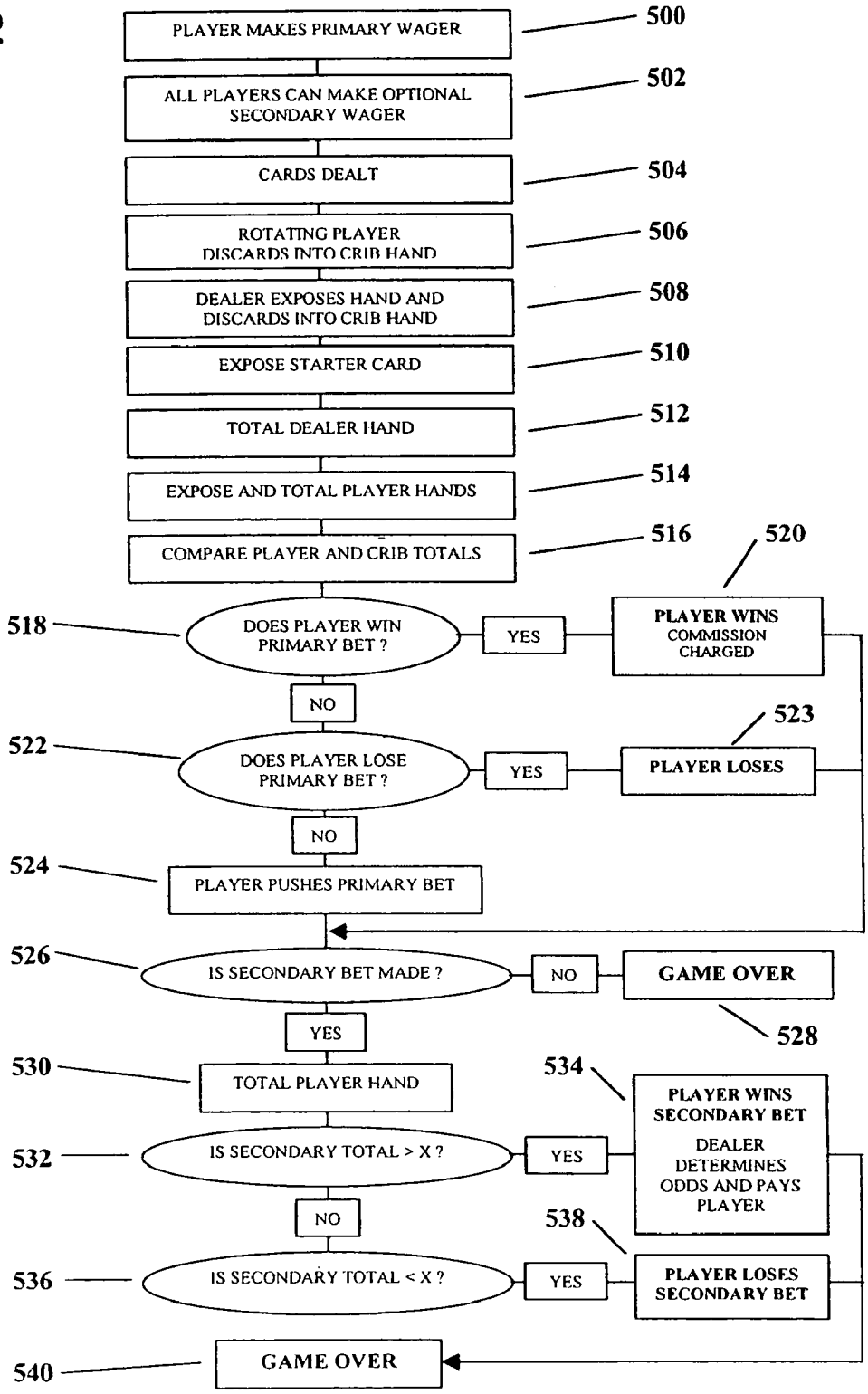
FIG. 12 is a flow chart representation of a cribbage game according to the present system having a crib hand and multiple players.

FIG. 12 is a flow chart representation of yet another embodiment of a cribbage game according to FIG. 11 having a crib hand and multiple players. This embodiment varies from the embodiment in FIG. 11, in that there are multiple players and at act 502 all players have the option to make a secondary wager. At act 506, rotating players discard two cards into the crib hand. For example, for the first hand, player one discards into the crib hand and for the second hand, player two discards into the crib hand, and so on.

In the embodiment set forth in FIG. 12, all players would have the opportunity to bet on the Crib hand, with one designated player who would contribute his discards into the Crib. The Crib play option would again rotate to give all players the opportunity to play their discards.

After the regular hands are paid and taken, the Crib is exposed and any player who bet on the Crib would win an odds payoff based on the original or a second payoff chart.

Figure 13:
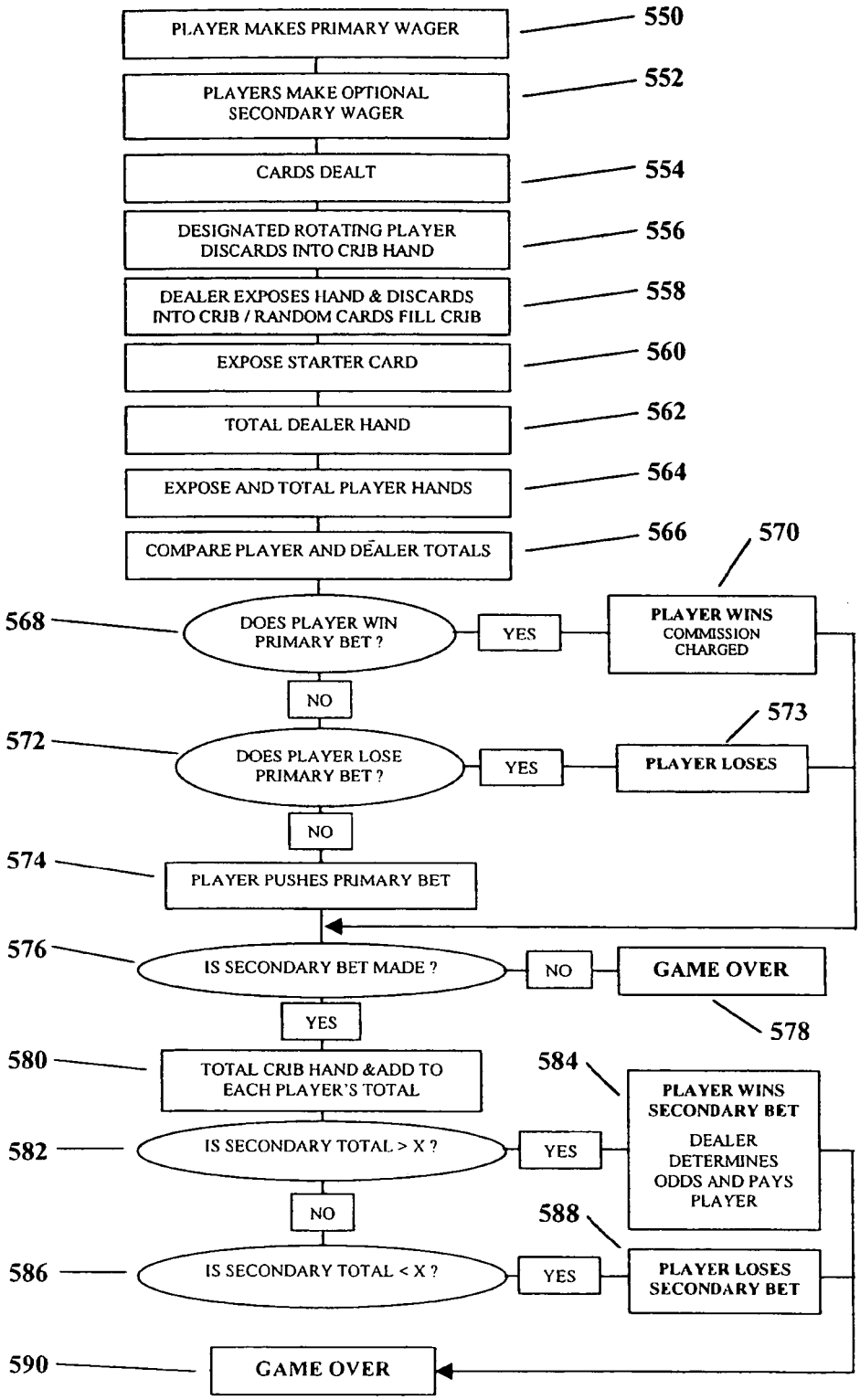
FIG. 13 is a flow chart representation of a cribbage game according to the present system comprising a method of playing wherein points are totaled in player hand and crib hand.

FIG. 13 is a flow chart representation of a cribbage game according to the present system comprising a method of playing wherein points are totaled in player hand and crib hand. In this embodiment, a specified player's discards go toward a "Crib" hand. The dealer would add the remaining cards to complete the Crib whether it was 2 or 3 cards (or all random). After the initial hand is played, the points for that hand are added to the total of the Crib hand and overall total points for the combined hands are determined. These total points would then be reflected in an overall game payoff chart, once again paying odds based on the value of the total points earned.

Payoff Chart—Hand and Crib Combined (example):

| | |
|---|---|
| 9 to 10 points | 1 to 1 |
| 11 to 13 points | 3 to 1 |
| 14 to 16 points | 5 to 1 |
| 17 to 19 points | 10 to 1 |

-continued

| | |
|---|---|
| 20 to 24 points | 20 to 1 |
| 25 to 29 points | 50 to 1 |
| 30 to 34 points | 100 to 1 |
| 35 to 39 points | 250 to 1 |
| 40 to 53 points | 1000 to 1 or Jackpot |

53 points is the highest point total possible which would include a 29 point hand (which requires a "5" as the common card) and a 24 point hand in the Crib, which would be a double-double run with a 4-4-6-6. A bonus payoff can be incorporated when a 28 or 29-point hand is received in either the Crib or the initial hand.

Referring still to FIG. 13, at act 550, the game begins when the players make the primary wager. At act 552, the players may make a secondary wager. Next, six cards are dealt to each player and dealer at act 554. At act 556, the designated rotating player discards two cards into the crib hand. Next, the dealer exposes his hand and discards two cards into and completing the crib hand or 2 to 4 random cards complete the crib at act 558. At act 560, the starter card is exposed. At act 562, the dealer hand total point value is determined. Next, the player hands are exposed and the player hand total point values are determined at act 564. At act 566, the player hand total point values are compared to the dealer hand total point value. At query 568, it is determined whether player hand total point values are greater than the dealer hand total point value. If the player hand total point values are greater than the dealer hand total point value the player or players win the primary wager and pay a commission at act 570. At query 572, it is determined if the player hand total point values are less than the dealer hand total point value. If it is determined if the player hand total point values are less than the dealer hand total point value, the player or players lose the primary wager at act 573 and proceed to query 576. If the player hand total point value is equal to the dealer hand total point value, the player or players push the primary bet at act 574. At query 576, it is determined whether the player made a secondary wager. If the player or players did not make a secondary wager, the game is over at act 578. If the player or players did make a secondary wager, the crib hand is exposed and totaled and added to the player's total at act 580. At query 582, it is determined whether the player hand overall total point values are greater than X. If it is determined if the player hand total point values are greater than X, then the player or players win the secondary wager and the dealer determines odds and pays the player or players based on the payoff chart at act 584. At query 586, it is determined whether the player hand total point values are less than X. If it is determined if the player hand total point values are less than X, then the player or players lose the secondary wager at act 588. The game is over at act 590.

Figure 14:
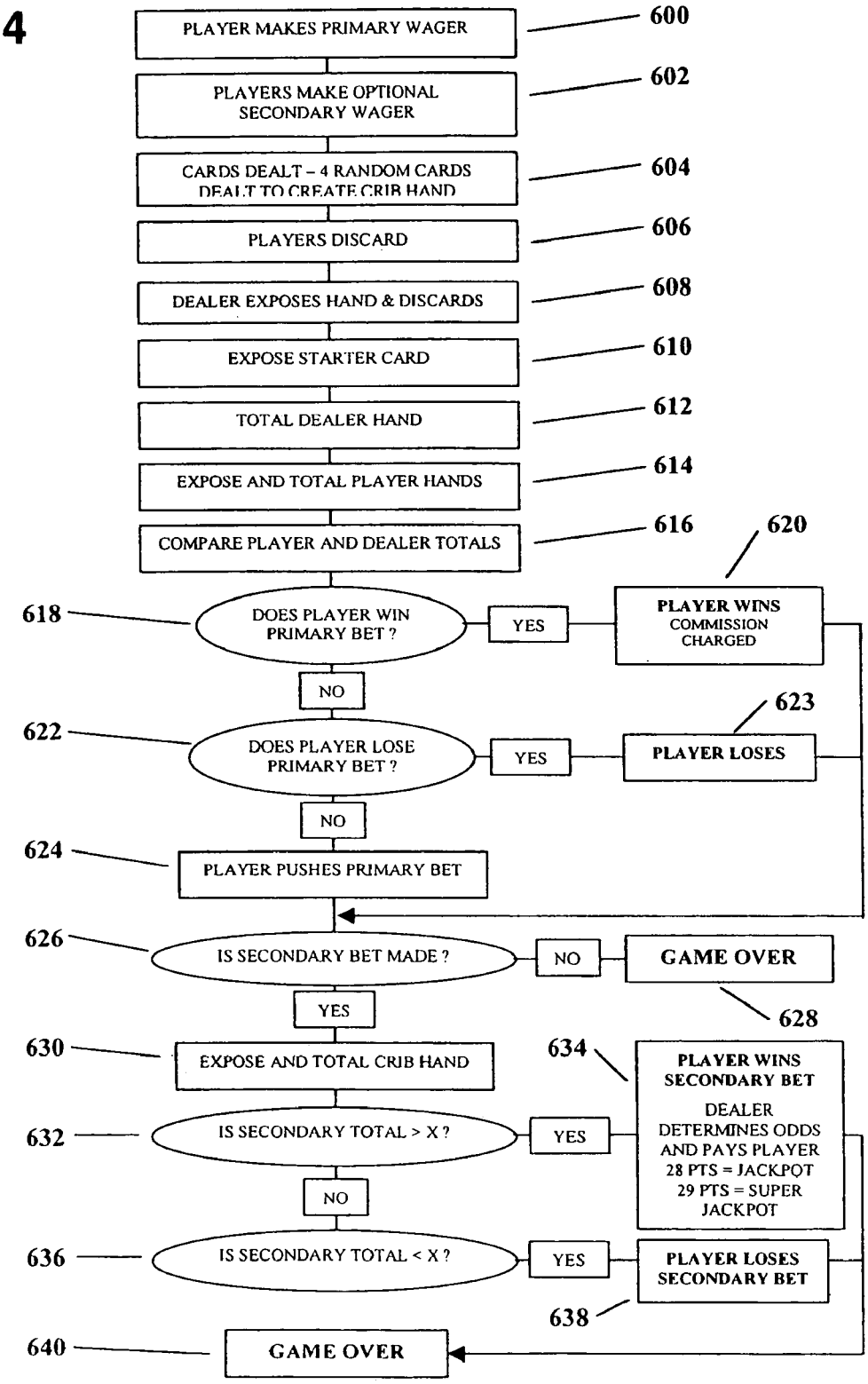
FIG. 14 is a flow chart representation of a cribbage game according to the present system having a random card crib hand.

FIG. 14 is a flow chart representation of yet another embodiment of a cribbage game according to the present system having a random card crib hand. At act 600, the game begins when the players make the primary wager. At act 602, the players may make a secondary wager. Next, six cards are dealt to each players and dealer and four random cards are dealt to the crib at act 604. At act 606, the players discard two cards. Next, the dealer exposes his hand and discards at act 608. At act 610, the starter card is exposed. At act 612, the dealer hand total point value is determined. Next, the player hands are exposed and the player hand total point values are determined at act 614. At act 616, the player hand total point values are compared to the dealer hand total point value. At query 618, it is determined whether player hand total point values are greater than the dealer hand total point value. If the player hand total point values are greater than the dealer hand total point value the player or players win the primary wager and pay a commission at act 620. At query 622, it is determined if the player hand total point values are less than the dealer hand total point value. If it is determined if the player hand total point values are less than the dealer hand total point value, the player or players lose the primary wager at act 623 and proceed to query 626. If the player hand total point value is equal to the dealer hand total point value, the player or players push the primary bet at act 624. At query 626, it is determined whether the player made a secondary wager. If the player or players did not make a secondary wager, the game is over at act 628. If the player or players did make a secondary wager, the crib hand is exposed and totaled at act 630. At query 632, it is determined whether the player hand total point values are greater than X. If it is determined if the player hand total point values are greater than X, then the player or players win the secondary wager and the dealer determines odds and pays the player or players based on the payoff chart at act 634. At query 636, it is determined whether the player hand total point values are less than X. If it is determined if the player hand total point values are less than X, then the player or players lose the secondary wager at act 638. The game is over at act 640.

Figure 15A:
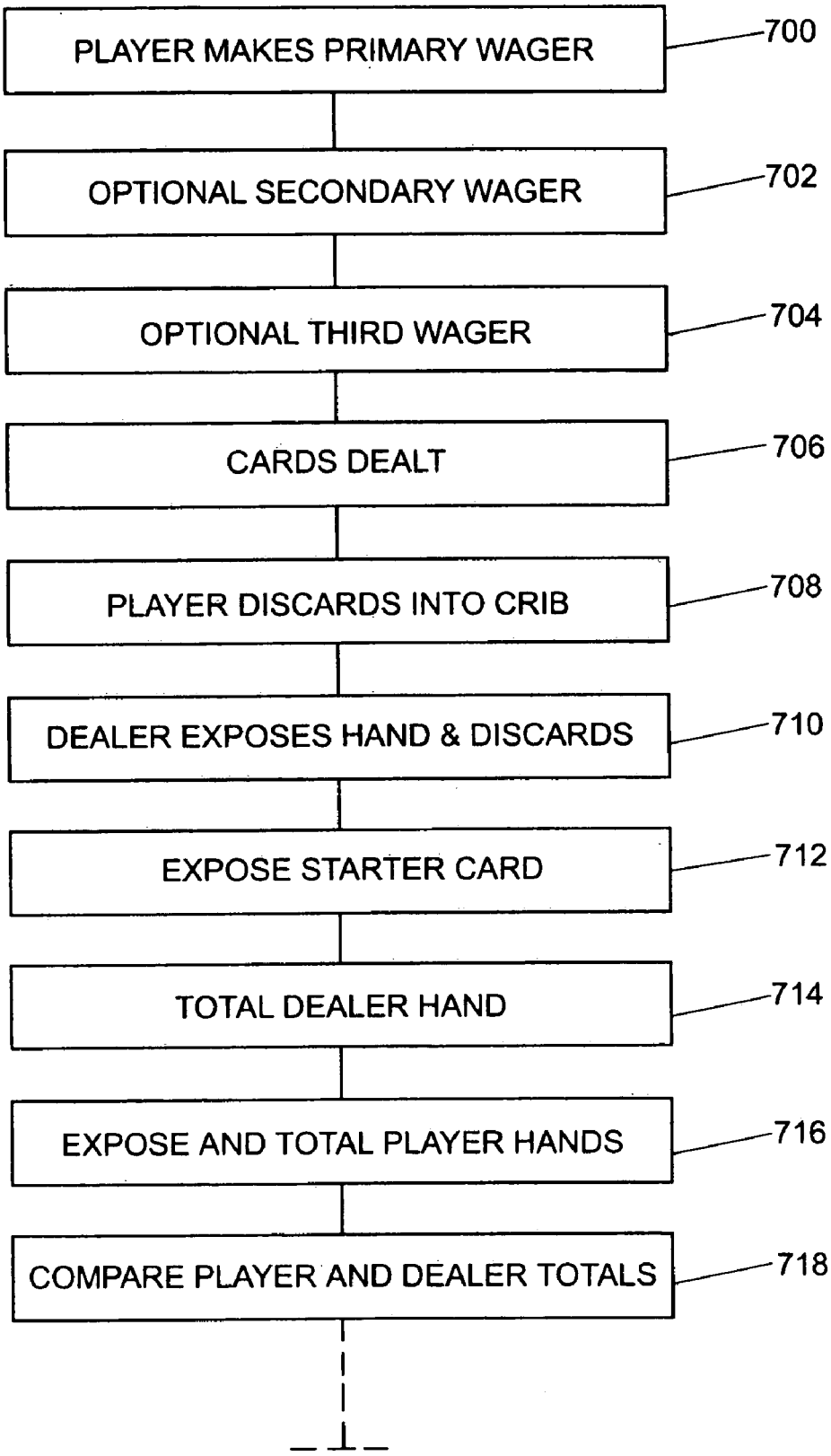
FIGS. 15*a* and 15*b* is a flow chart representation of a cribbage game according to the present system comprising a method of playing cribbage on a video slot machine.
Figure 15B:
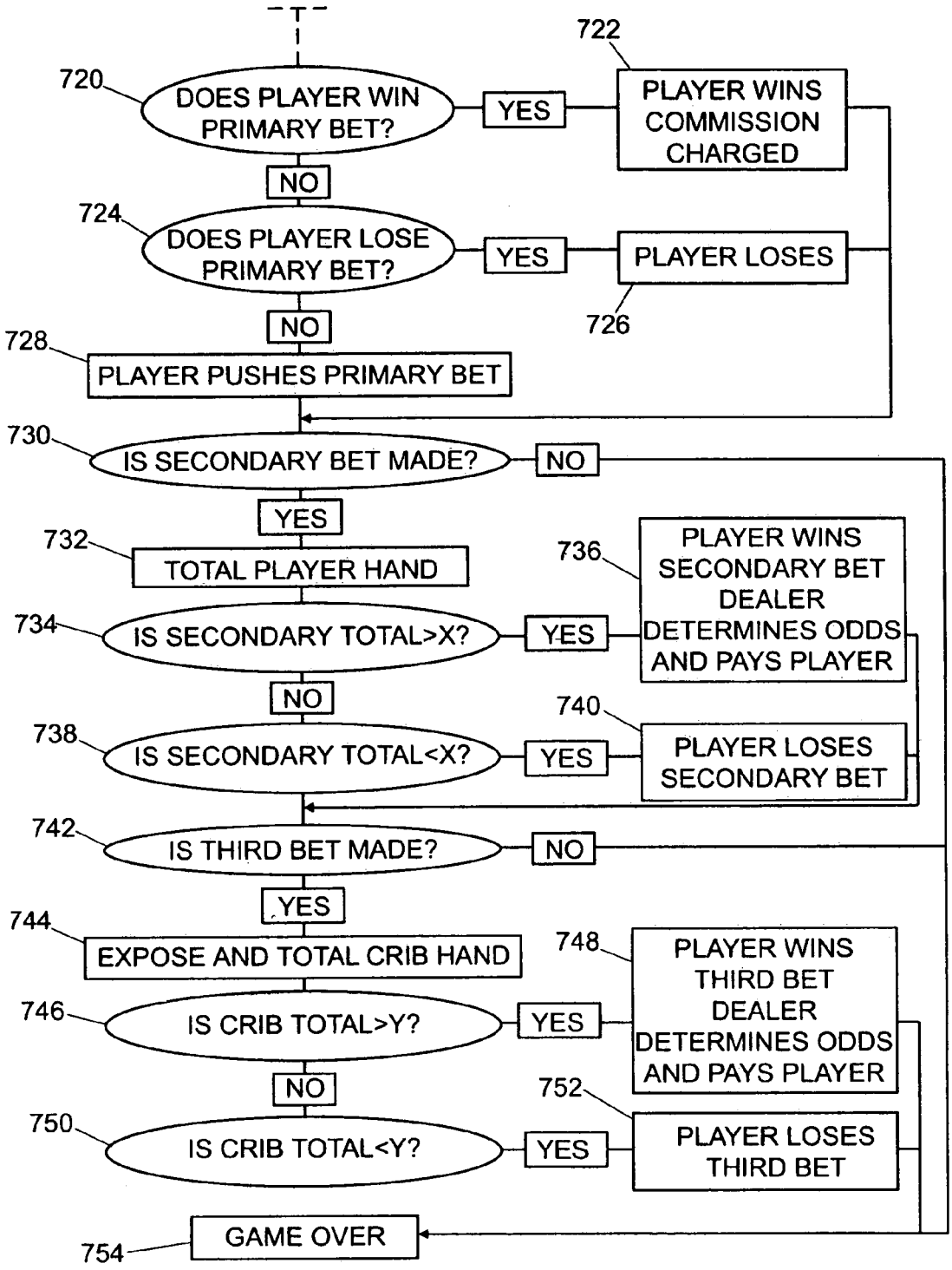

FIG. 15*a* and FIG. 15*b* is a flow chart representation of a video slot machine version of the cribbage game of the present system. FIG. 15*a* and FIG. 15*b* will be discussed in greater detail below. The video slot format offers an excellent venue for Casino Cribbage. Since a set of house rules can be programmed into the slot machine, the player would have the opportunity to play the Basic version I, method A with a 1 to 1 payoff. Version II, six card method could easily be incorporated as a secondary wager and Crib Method I or IV could be added as an optional third wager.

The machine would have button and/or touch screen functions that would operate coins in, betting, dealing, holding and discarding of cards, playing credits, cashing out, etc. The video screen would display cards for player, dealer and crib hands. Numeric displays would show units bet, total credits, point totals of hands, payoff charts, etc.

Play would begin with the insertion of coins or the play of credits on wager 1 and optionally on wagers 2 & 3. The deal button would begin the game with the display of six cards face up for the player and six face down for the dealer and one "starter card" face down. The player would select two cards that they wanted to discard into the crib hand by pressing the corresponding buttons. After the cards are discarded, the machine would display the dealer hand and discard its two cards into the crib hand.

The starter card would then be displayed and total points would be determined and displayed for both the player and dealer hands, both of which share the starter card to total points. Points would be counted using traditional Cribbage scoring methods.

The machine would display whether the player won, lost or pushed the hand. If won, the appropriate credits would be added to the player's bankroll, and conversely, if the player lost, the player's bankroll would be debited appropriately. A tie or "push" would not affect the player's credits.

If the player did not play the optional wagers, the game would be over and would be ready to begin a new game. The player could either cash out, or play again. If the player had played the optional wagers, the game would continue to determine the outcome of those wagers.

If the secondary wager were made, the machine would display the payoff chart for the corresponding amount of points accumulated by the hand.

If the third wager was played, the machine would then go to the next step of displaying the crib hand and calculate the amount of points including the starter card for that hand. The machine would then display the payoff chart for the amount of points accumulated and show if the player had lost or won an odds based payoff for the crib hand.

Again the appropriate credits would be either added to or subtracted from the player's bankroll and displayed on the video screen.

Referring still to FIG. 15*a* and FIG. 15*b*, a flow chart representation of a cribbage game according to the present system comprising a method of playing cribbage on a video slot machine is illustrated. A software module stored on a computer hard drive, on a floppy disk or on a CD Rom performs the method disclosed. At act 700, the game begins when the player makes the primary wager. At act 702, the player may make a secondary wager. At act 704, the player may make an optional third wager. Next, six cards are dealt to the player at act 706. At act 708, the player discards two cards into the crib hand. Next, the video dealer exposes its hand and discards two cards into the crib hand at act 710. At act 712, the starter card is exposed. At act 714, the video dealer hand total point value is determined. Next, the player hand total point value is determined at act 716. At act 718, the player hand total point value is compared to the dealer hand total point value. At query 720, it is determined whether player wins the primary bet. If the player hand total point value is greater than the dealer hand total point value the player wins the primary wager and pays a commission at act 722. At query 724, it is determined if the player hand total point value is less than the dealer hand total point value. If the player hand total point value is less than the video dealer hand total point value, the player loses the primary wager at act 726 and proceeds to query 730. If the player hand total point value is equal to the video dealer hand total point value, the player pushes the primary bet at act 728 and proceeds to query 730. At query 730, it is determined whether the player made a secondary wager. If the player did not make a secondary wager, the game is over at act 749. If the player did make a secondary wager, the player hand total point value is counted at act 734. At query 732, it is determined whether the second player hand total point value is greater than X. If the second player hand total point value is greater than X, the player wins the second wager and the payoff chart is displayed and winnings are paid at act 736. At query 738, it is determined whether the player hand total point value is less than X. If it is determined that the player hand total value is less than X, then the player loses the secondary wager at act 740. At query 742, it is determined whether the player made a third wager. If the player did not make a third wager, the game is over at act 749. If the player did make a third wager, the crib hand is exposed and totaled at act 744. At query 745, it is determined whether the crib hand total point value is greater than Y. If it is determined if the crib hand total point value is greater than Y, then the player wins the third wager and the module determines odds and pays the player based on the payoff chart at act 746. At query 747, it is determined if the crib hand total point value is less than Y, then the player loses the third wager at act 748, and the game is over at act 749.

Figure 16:
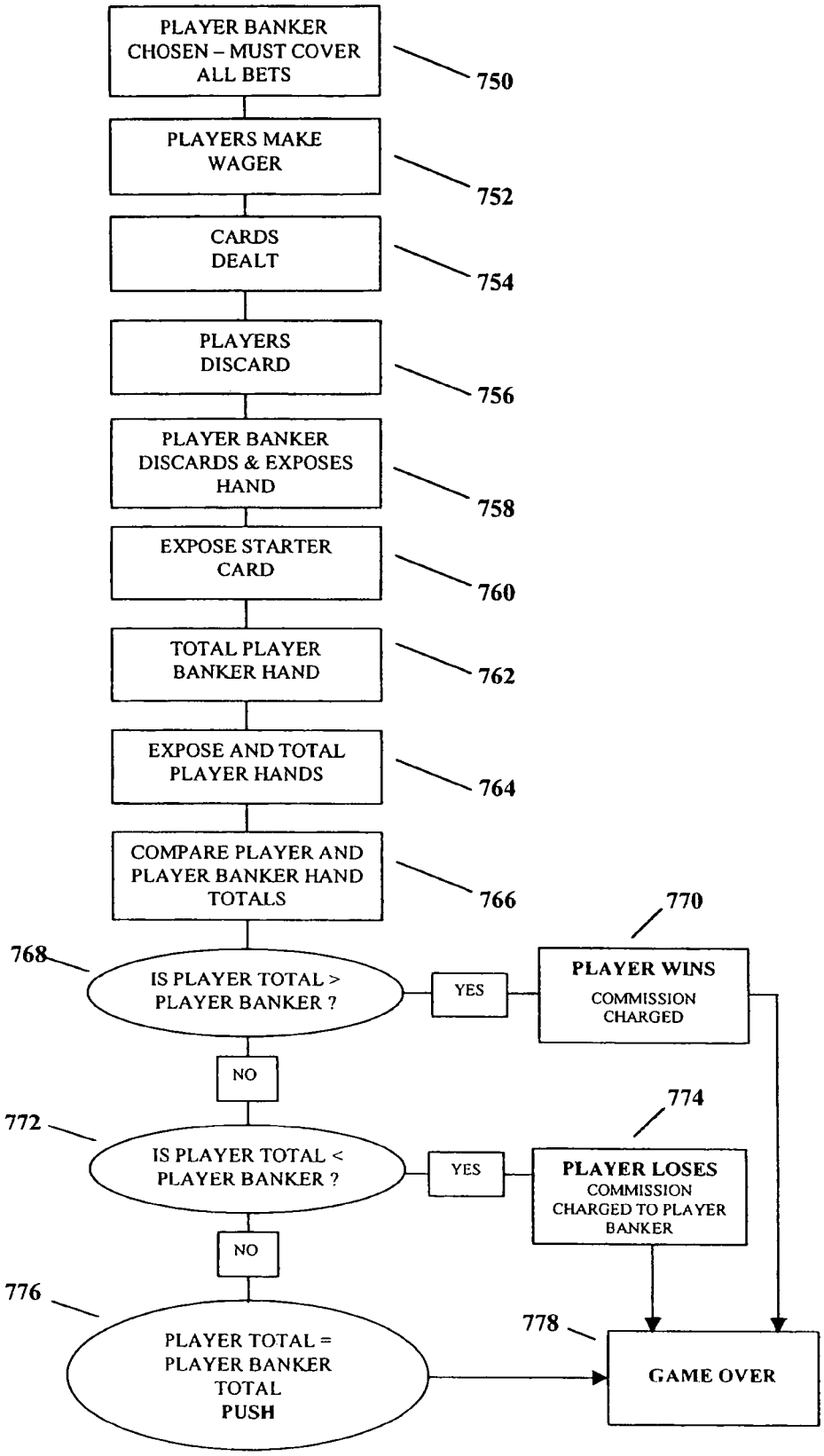
FIG. 16 is a flow chart representation of a cribbage game according to the present system having a rotating player banker versus multiple players in a card room format.

FIG. 16 is a flow chart illustrating a card room version of playing a cribbage game of the present system. FIG. 16 will be discussed in detail below. In a player versus player venue, hands could be compared to each other for a 1 to 1 win/loss without the necessity for a set of "House Rules" to be developed or taught. Each participant plays their hand using their own strategy for determining which cards to hold and discard that they feel would yield the best results.

As in certain card rooms or tribal casinos, if the house is not allowed to participate in the banking of the game, the play would simply involve participants playing against each other and the house taking a percentage of the wagers. This would also allow for an unlimited betting range where the House collects commissions on winning wagers.

The play would begin with the each player making a wager. Once the wagers are determined, another player (player banker) would be determined who could cover all the declared bets and would play his hand against all the other players. The house dealer would then deliver six cards to each player and one shared card (starter) would be dealt face down in the center of the table with some type of marker to identify and protect the card. The players would then each discard two cards.

After each player and the player banker have discarded, the starter card would be exposed and the player banker's hand would be exposed and the total points for his hand including the starter card would be determined. Each player's hand would then be exposed in turn, total points determined with the starter card, and compared to the player banker hand to determine which hands win, loss or push.

After all hands have been compared to the player banker hand, the total amount of wagers are determined by the house dealer that the player banker either has to pay or collect from the other players. A commission (i.e. 5%) would be collected on all winning bets, which goes to the house.

Referring back to FIG. 16, a flow chart representation of playing a cribbage game according to the present system comprising a card room version is shown. The game begins at act 750 when a player banker is chosen. At act 752, the players make wagers. Next, the cards are dealt at act 754. At act 756, the players discard either one or two cards depending on the number of players. Next, the player banker discards and exposes his or her hand at act 758. At act 760, the starter card is exposed. The player banker hand is exposed at act 762. At act 764, the player hands are exposed and totaled. Next, the players' and the player banker's hands are exposed at act 766. At query 768, it is determined whether the player's hand total point value is greater than the player banker hand total point value. If the player's hand total point value is greater than the player banker hand total point value then the player wins and a commission is charged at act 770 and the game is over at act 778. At query 772, it is determined whether the player's hand total point value is less than the player banker hand total point value. If the player's hand total point value is less than the player banker hand total point value then the player loses and the player banker pays a commission at act 774 and the game is over at act 778. The player's hand total point value is equal to the player banker hand total point value and the hand is a push at act 776, the game is over at act 778.

Figure 17:
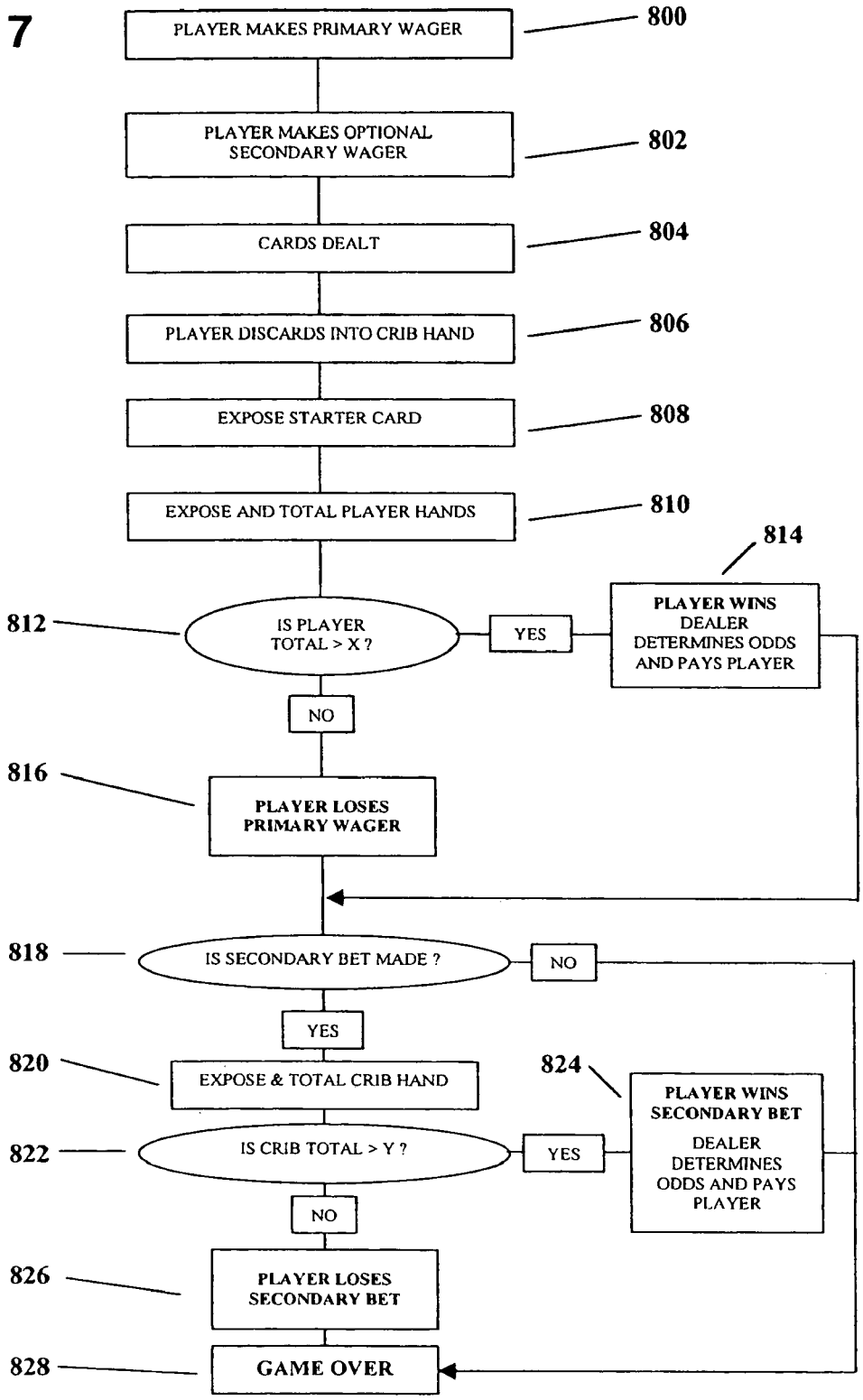
FIG. 17 is a flow chart representation of a casino version of a cribbage game according to the present system having two payoff charts.

FIG. 17 is yet another embodiment of a method of playing cribbage according to the present system. FIG. 17 is discussed in greater detail below. As an alternative to creating a casino version without a complicated set of House Rules that would result in a slow game pace, the elimination of this step would speed up the game and still offer two chances for a player to win an odds based payoff.

The first payoff chart would be for the player's initial hand after discarding. The second payoff chart would be for the Crib hand that all players could share. By using four random cards, a higher payoff chart could be offered, as it is more difficult to receive higher point values without a discard opportunity.

The Crib portion could be optional for the player, but with a much higher payoff chart, it should be an attractive wager. With the odds of five random cards creating 28 and 29 point hands being approximately 46,511 to 1 and 3 million to 1 respectively, a major jackpot could be offered for the 28 point hand and a "super jackpot" could be offered for the 29 points hand.

FIG. 17 is a flow chart representation of a casino version of playing a cribbage game according to the present system having two payoff charts. The game begins at act 800 when the players make their primary wagers. At act 802, the player makes an optional secondary wager. Next, the cards are dealt at act 804. At act 806, the players discard. At act 808, the starter card is exposed. At act 810, the player hands are exposed and the player hand total point value is calculated. At query 812, it is determined whether the player hand total point value is greater than X. If the player hand total point value is greater than X, then the player wins and the dealer determines the odds and pays the player based on a payoff chart at act 814 and the player proceeds to query 818. If the player hand total point value is less than X, it loses at act 816. It is determined at query 818 whether the player made a secondary wager. If the player did not make a secondary wager, the game is over at act 828. If the player did make a secondary wager, the crib hand is exposed and totaled at act 820. At query 822, it is determined whether the crib hand total point value is greater than Y. If the crib hand total point value is not greater than Y, the player loses at act 826 and the game is over at act 828. If the crib hand total point value is greater than Y, the player wins and the dealer determines the odds and pays the player based on a payoff chart at act 824 and the game is over at act 828.

Figure 18A:
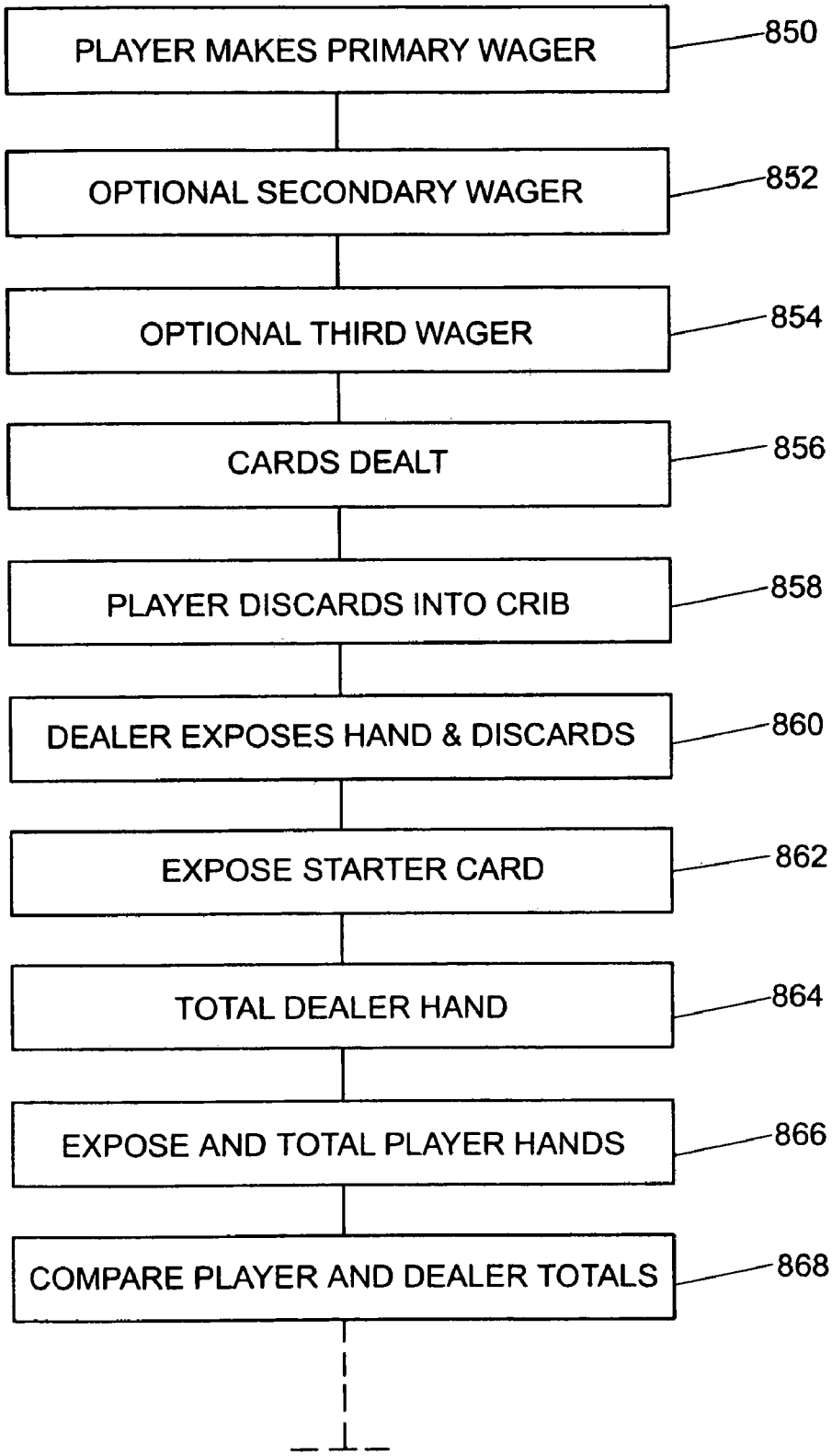
FIGS. 18*a* and 18*b* is a flow chart representation of a house banking casino version of a cribbage game according to the present system having triple wagers.
Figure 18B:
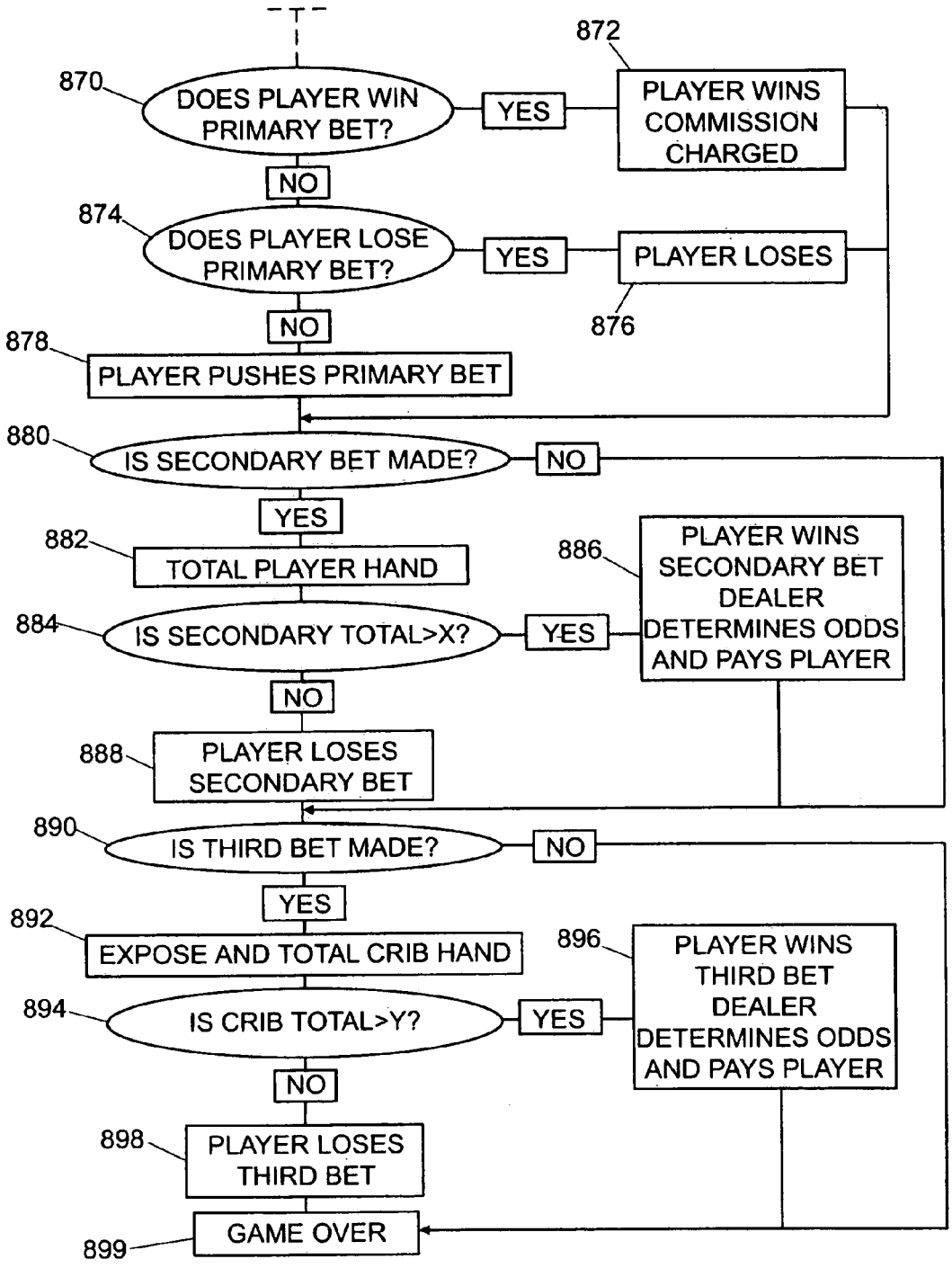

FIG. 18*a* and FIG. 18*b* is yet another embodiment of a method of playing cribbage according to the present system. FIG. 18*a* and FIG. 18*b* is discussed in greater detail below. In a house-banking format, a set of pre-established criteria or "House Rules" would need to be created in order for the dealer to make discarding decisions. Once the House Rules are defined and taught to the dealers, a 1 to 1 comparison can be made between player's hands and the house dealer hand. This would also allow for a greater betting range than Table Game Version II (up to $1000 or more), which would provide greater commissions. Additional wagers can now be made on second or third events occurring.

Optional player banking can be incorporated on a rotational basis. The house could decide upon what type of rotation would be preferable. Secondary wagers could still be made which the house would cover.

Play would begin with players making their bets against the house for the primary 1 to 1 wager. The players would have the option of making a second or third bet on the value of their hand and the value of the crib hand. If only one player bets on the crib hand, that player will contribute their discards into the crib hand. If more than one player participates in the crib side bet, one of these players must be decided upon who will contribute their discards into the crib hand.

Once the bets have been made and the designated crib player is determined, the dealer would deliver six cards to each player, the dealer and one face down as the starter card. The players will look at their hands first and discard two cards from their hand. The designated crib player will discard their two cards into the crib hand. After all players have discarded, the dealer will expose his hand and discard based upon the pre-determined house rules. The dealer's two discards will complete the crib hand.

Once the dealer has discarded, the starter card will be exposed. The dealer will then count and total all the points in the dealer hand including the starter card. This will be the point value that each player will need to exceed in order to win the primary bet. Each player's hand is exposed in turn and the point value determined including the starter card. The primary wager is determined to win, lose or tie (push) against the dealer's hand.

If a secondary bet is played, the dealer will determine at that time if it is high enough to receive an odds based payoff. The secondary bet is independent of the primary bet and may win or lose regardless whether the primary bet wins or loses.

The attraction of high possible payoffs would create incentive to play the secondary wager along with the primary wager. The primary bet being played as a requirement to being able to play the secondary bet. Depending upon the results of the mathematics, the secondary wager may be larger than the primary wager. The third bet will be determined after the crib hand is exposed.

After all player's hands have been shown, determined winner or loser for the primary and secondary bets, the dealer will discard his hand and leave the starter card remaining face up. The crib hand will then be exposed for any players betting on the crib hand.

The dealer will count and total all the points in the crib hand including the original starter card. If the total points in the crib hand qualify for an odds based payoff, all players wagering on the crib hand will win the same odds payoff and be paid according the amount of the individual wager.

FIG. 18*a* and FIG. 18*b* is a flow chart representation of a house banking casino version of playing a cribbage game according to the present system having an optional player banker. The game begins at act 850 when the player makes a primary wager. At act 852, the players make an optional second wager. At act 854, the players make an optional third wager. Next, the cards are dealt at act 856. At act 858, the players discard into the crib hand. Next, the dealer exposes his or her hand and discards into the crib hand at act 860. In another embodiment, the dealer may discard and deal random cards into the crib hand. At act 862, the starter card is exposed. Next, the dealer hand is totaled at act 864. At act 866, the players' hands are exposed, total point value is calculated and at act 868 the hands are compared to the dealer hand. At query 870, it is determined whether the player hand total point value is greater than the dealer hand total point value. If the player hand total point value is greater than the dealer hand total point value, then the player wins the primary bet and a commission is paid at act 872. It is determined at query 874 if the player hand total point value is less than the dealer hand total point value. If the player hand total point value is less than the dealer hand total point value, the player loses at act 876 and proceeds to query 880. If the player hand total point value is not less than the dealer hand total point value, the player pushes the primary bet at act 878. At query 880, it is determined whether the player made a secondary wager. If the player did not make a secondary wager, the player proceeds to query 890. If the player made a secondary wager, the player hand is totaled at act 882. At query 884, it is determined whether the player hand total point value is greater than X. If the player hand total point value is greater than X, the player wins and the dealer pays odds based on a payoff chart at act 886. If the player hand total point value is less than X, the secondary wager loses at act 888. It is determined whether the player made a third wager at query 890. If the player did not make a third wager, the game is over at act 899. If the player did make a third wager, the crib hand is exposed and the crib hand total point value is calculated at act 892. At query 894, it is determined whether the crib hand total point value is greater than Y. If the crib hand total point value is not greater than Y, the third wager loses at act 898 and the game is over at act 899. If the crib hand total point value is greater than Y, the player wins the third wager and the dealer pays odds based on a crib payoff chart at act 896. The game is over at act 899.

Figure 19A:
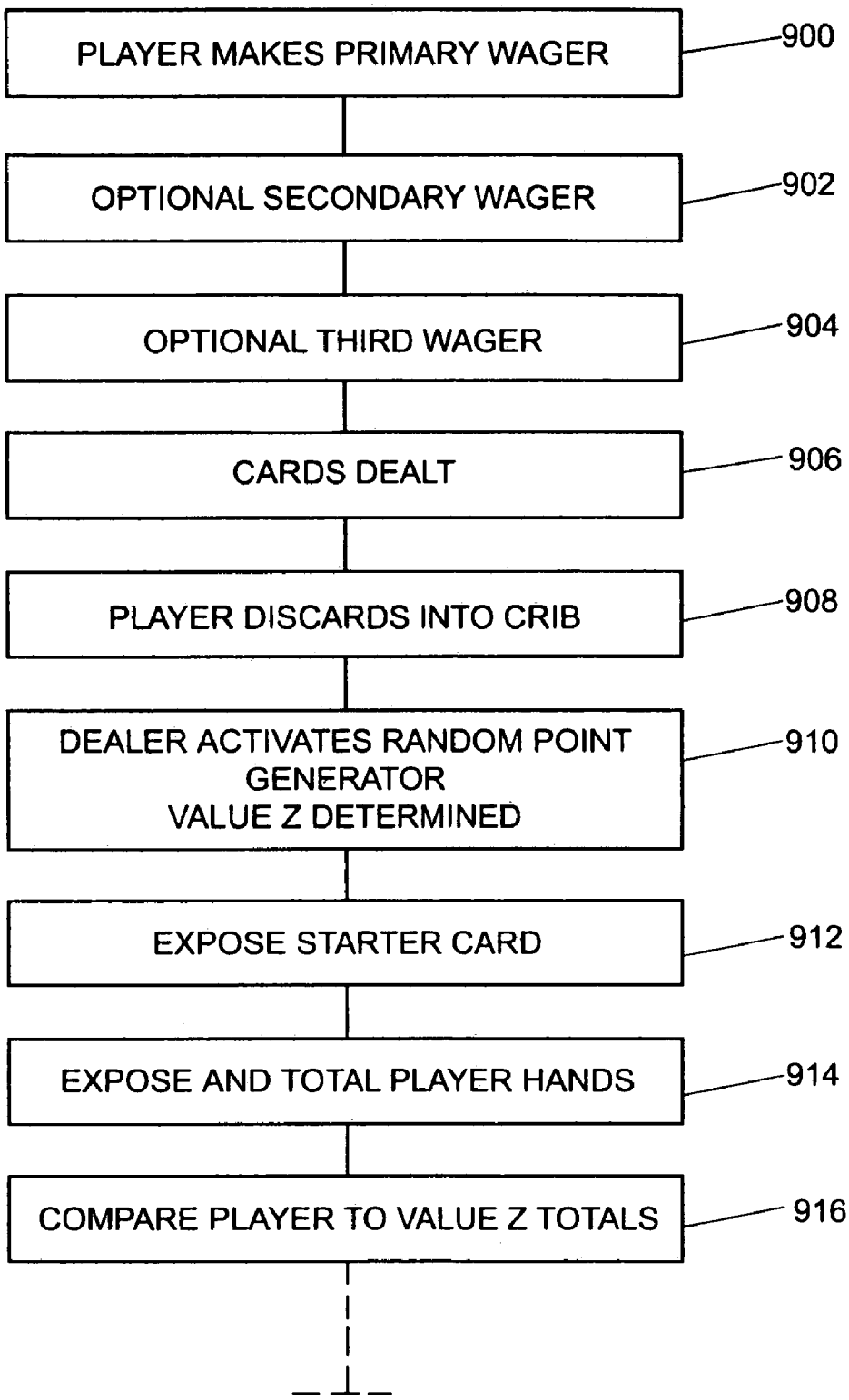
FIGS. 19*a* and 19*b* is a flow chart representation of a house banking casino version of a cribbage game according to the present system having triple wagers with a random hand dealer total.
Figure 19B:
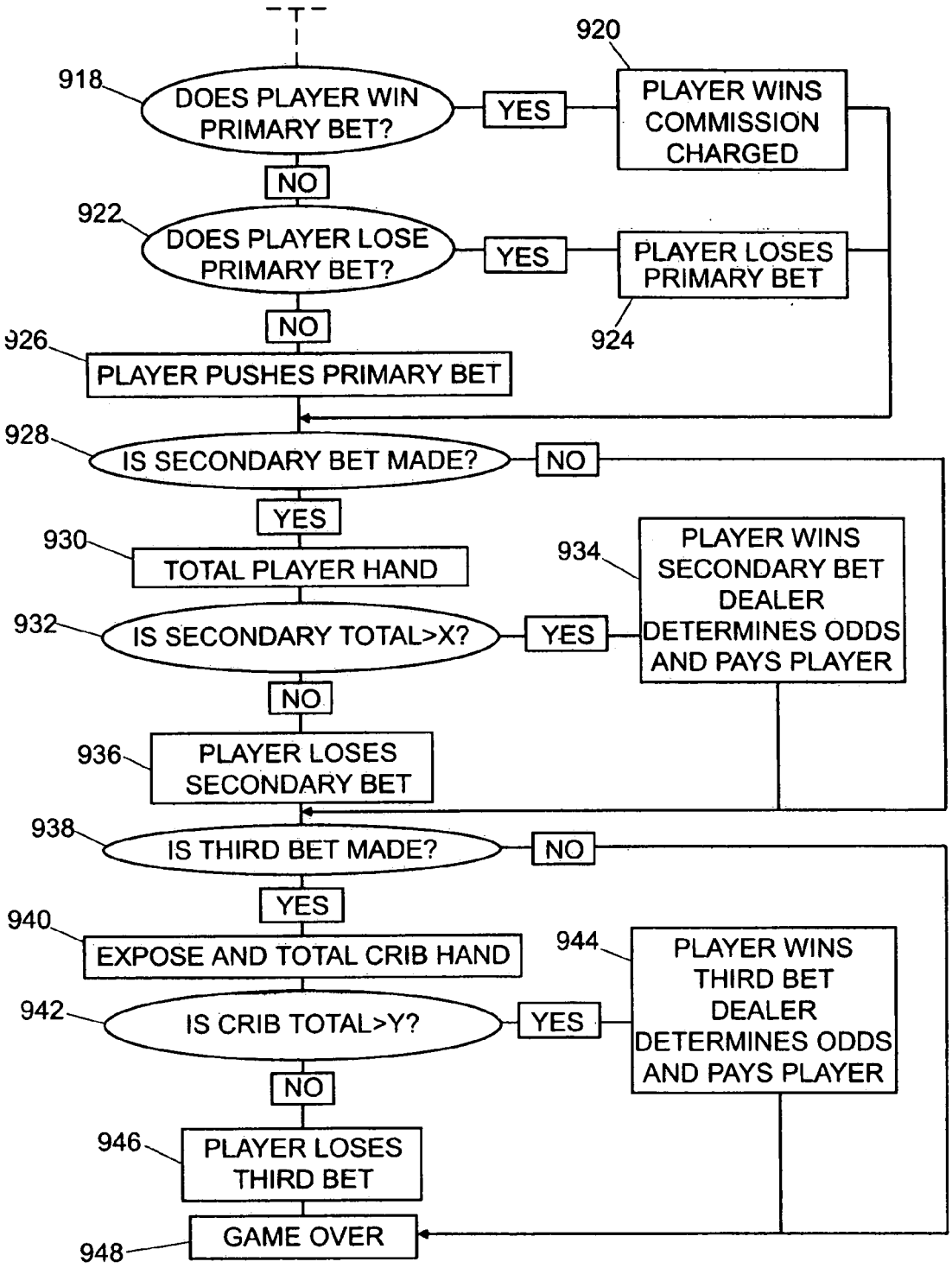

FIG. 19*a* and FIG. 19*b* is a flow chart representation of a house banking casino version of playing a cribbage game according to the present system having a random dealer hand total. The game begins at act 900 when the player makes a primary wager. At act 902, the players make an optional second wager. At act 904, the players make an optional third wager. Next, the cards are dealt at act 906. At act 908, the players discard into the crib hand. Next, at act 910 the dealer activates a random point generator to determine value Z. At act 912, the starter card is exposed. At act 914, the players' hands are exposed, total point value is calculated and at act 916 the hands are compared to the dealer hand. At query 918, it is determined whether the player hand total point value is greater than Z. If the player hand total point value is greater than Z, then the player wins the primary bet and a commission is paid at act 920. It is determined at query 922 if the player hand total point value is less than Z. If the player hand total point value is less than Z, the player loses at act 924 and proceeds to query 928. If the player hand total point value is equal to the dealer hand total point value, the player pushes the primary bet at act 926. At query 928, it is determined whether the player made a secondary wager. If the player did not make a secondary wager, the player proceeds to query 938. If the player made a secondary wager, the player hand is totaled at act 930. At query 932, it is determined whether the player hand total point value is greater than X. If the player hand total point value is greater than X, the player wins and the dealer pays odds based on a payoff chart at act 934. If the player hand total point value is less than X, the secondary bet loses at act 936. It is then determined whether the player made a third wager at query 938. If the player did not make a third wager, the game is over at act 948. If the player did make a third wager, the crib hand is exposed and the crib hand total point value is calculated at act 940. At query 942, it is determined whether the crib hand total point value is greater than Y. If the crib hand total point value is not greater than Y, the player loses the third bet at act 946 and the game is over at act 948. If the crib hand total point value is greater than Y, the player wins and the dealer pays odds based on a crib payoff chart at act 944. The game is over at act 948.

In yet another embodiment, pegging as in traditional cribbage is used to create an additional aspect of a method of playing cribbage according to the present system. Scoring during the pegging portion of the game can be used to determine a winning wager. This can be used in conjunction with other versions or combinations of Casino Cribbage or as a stand-alone game. Recording running scores can be done with a traditional Cribbage style board or through video or electronic displays.

Scoring by using traditional Cribbage pegging methods, a single player can win a 1 to 1 payoff on a wager by playing alternating cards against a house dealer (video slot or live dealer) and each player scoring a separate running total until all cards are played.

After all cards are played, the player wins his bet if he achieves a higher running total than the dealer does for that round. If the player has fewer points than the dealer does, the player's wager is lost, and if the totals are equal, the wager is a "push" and no money is won or lost.

EXAMPLE

| | Player | Score | Dealer | Score |
|---|---|---|---|---|
| 1st card | plays "4" | 0 | plays "6" for 10 | 0 |
| 2nd card | plays "5" for 15 | 2 for 15 + 3 for run | plays "7" for 22 | 4 for run |
| 3rd card | plays "9" for 31 | 2 for Go | plays "7" for 7 | 0 |
| 4th card | plays "7" for 14 | 2 for pair | plays "Ace" for 15 | 2 for 15 + 1 for last card |
| Total Running Score | | 9 Points | | 7 Points |

In the example set forth above, the player would win with a score of 9 points, beating the 7 points scored by the dealer. The player would win an equal payoff for the amount of the player's wager, possibly with a small commission charged to maintain a viable house advantage.

A video slot embodiment may be programmed to play an optimal strategy or a set of house rules to determine play can be created for live dealers.

In yet another method of playing cribbage including pegging, a player can win a payoff after reaching a fixed or random minimum required value. Using a fixed value of 4 in the example, the player has reached and exceeded the minimum value and therefore would win a 1 to 1 payoff.

In this embodiment, using a random value, before the game starts, the dealer or player would operate a mechanism or activate a random value generator. Once the minimum value is determined, the player would win a 1 to 1 payoff upon reaching that total.

In yet another embodiment, an odds based payoff can be made for an overall point total reached by the player. Similar to Version 2, a 1 to 1 payoff can be made upon reaching a minimum value, and larger payoffs can be made for greater point values reached above the minimum.

Sample payoff chart:

| Point Total | Payoff | Point Total | Payoff |
|---|---|---|---|
| 5 to 6 | 1 to 1 | 12 to 13 | 25 to 1 |
| 7 to 8 | 3 to 1 | 14 to 15 | 50 to 1 |
| 8 to 9 | 5 to 1 | 16 to 17 | 100 to 1 |
| 10 to 11 | 10 to 1 | 18 or more | 1000 to 1 or Jackpot |

In yet another embodiment, as a variation, using the same scoring and pegging method, an odds based payoff can be determined by the amount of point difference between the player and dealer hands. As an example, if the player wins by one point, he would win a 1 to 1 payoff as in Version 1, however, if the player won by 6 points, he would win a payoff of 10 to 1 (example).

| Point Differential | Payoff | Differential | Payoff |
|---|---|---|---|
| 1 | 1 to 1 | 7 to 9 | 15 to 1 |
| 2 | 2 to 1 | 10 to 13 | 20 to 1 |

-continued

| Point Differential | Payoff | Differential | Payoff |
|---|---|---|---|
| 3 | 3 to 1 | 14 to 16 | 50 to 1 |
| 4 | 4 to 1 | 17 to 19 | 100 to 1 |
| 5 | 5 to 1 | 20 or more | 1,000 to 1 or Jackpot |
| 6 | 10 to 1 | | |

With the maximum point difference being 21 points, a large jackpot or progressive jackpot can be offered for maximum values.

In yet another embodiment multiple players engage in playing cribbage using the peg board. With multiple players, each player can peg in order and scores can be tracked either by individual counts with the individual player scoring the highest points winning, or adding running totals together and all participants sharing a collectively accumulated point total. Payoff can be 1 to 1 or odds based for certain point levels reached.

It should be readily apparent to those skilled in the art that other combinations or modifications of these versions can be derived.

It should be understood that various alternatives to the embodiments of the disclosed method and apparatus descried herein maybe employed in practicing the disclosed method and using the disclosed apparatus. It is intended that the following claims define the scope of the disclosed method and apparatus and that methods and structures within the scope of these claims and their equivalents be covered thereby.

The invention claimed is:

1. A method of playing a casino table version of cribbage using at least one deck of conventional playing cards, having at least one player making a wager and having a dealer that deals the playing cards, said method comprising:

requiring at least one player to make a wager to receive a first plurality of playing cards;

dealing a first plurality of playing cards to each player;

dealing the dealer a second plurality of playing cards, which second plurality of playing cards is completed concurrently or after said each players are dealt said first plurality of cards;

requiring players to discard a third plurality of cards to form a fourth plurality of playing cards;

requiring said dealer to expose said dealer second plurality of cards and discard two cards to form a fifth plurality of cards;

exposing a single starter card;

totaling a value of said dealer's fifth plurality of cards alone or in combination with the single starter card;

exposing, totaling and comparing a value of said players' fourth plurality of cards alone or in combination with the single starter card to said dealer's fifth plurality of cards; and determining whether the player's fourth plurality of cards alone or in combination with the single starter card has a higher point value than the dealer's fifth plurality of cards alone or in combination with the single starter card.

2. A method for providing wagering in a game based upon the rules of cribbage comprising:

providing at least one deck of conventional playing cards;

receiving a primary wager on a player hand from a player;

dealing a plurality of at least four cards forming said player hand to said player;

determining a value of said player hand in accordance to cribbage scoring;

dealing only a single starter card;

comparing said value of said player hand of four player cards and the single starter card to at least one cribbage hand value total wagered on by the primary wager;

determining an outcome of said player hand responsive to said comparison; and resolving said primary wager responsive to a determination of said outcome.

3. The method of claim 2 further comprising: discarding at least one card from said hand by said player.

4. The method of claim 3 wherein said step of discarding said at least one card is prior to determining said value.

5. The method of claim 3 further comprising: creating a crib hand including each said at least one card discarded by said player.

6. The method of claim 5 further comprising: determining a value of said crib hand in accordance to cribbage scoring.

7. The method of claim 6 further comprising:

comparing said value of said crib hand to a cribbage hand value;

determining an outcome of a wager on the crib hand responsive to a comparison of said value of said crib hand and said cribbage hand value; and resolving a bet in response to a determination of said outcome of said wager on the crib hand.

8. The method of claim 2 wherein said step of determining said value of said crib hand comprises:

determining a value of said hand and said starter card in accordance to cribbage scoring.

9. The method of claim 2 wherein said hand value total value is a predetermined value according to counting rules for cribbage.

10. The method of claim 2 wherein said hand value total value is each of a plurality of values in a payoff table.

11. The method of claim 2 wherein said hand value total value is a random value.

12. The method of claim 2 wherein said hand value total value is a value of a hand of a plurality of cards determined in accordance to the rules of cribbage.

13. The method of claim 2 and further comprising:

receiving a secondary wager from said player;

comparing said value of said player hand to a secondary wager player hand value;

determining an outcome of the secondary wager responsive to said comparing of value of said player hand to said secondary wager player hand value; and resolving said secondary wager responsive to a determination of said outcome of said secondary wager.

14. The method of claim 13 wherein said secondary wager player hand value is a predetermined value.

15. The method of claim 13 wherein said secondary wager player hand value is each of a plurality of values in a payoff table.

16. The method of claim 13 wherein said secondary wager player hand value is a random value.

17. The method of claim 13 wherein said secondary wager player hand value is a value of a hand of a plurality of cards determined in accordance with the rules of cribbage.

18. The method of claim 13 further comprising:

generating a crib hand;

determining a value of said crib hand in accordance to cribbage scoring.

comparing said value of said crib hand to a crib wager hand value;

determining an outcome of a one of said primary wager and said secondary wager responsive to a comparison of said value of said crib hand and said crib wager value; and resolving any wager in response to a determination of said outcome of said wager.

19. The method of claim 18 wherein said crib wager value is a predetermined value.

20. The method of claim 18 wherein said crib wager hand value is each of a plurality of values in a payoff table.

21. The method of claim 18 wherein said crib wager hand value is a random value.

22. The method of claim 13 further comprising: receiving a tertiary wager from said player;

comparing said value of said hand to a tertiary wager hand value;

determining an outcome of the tertiary wager responsive to said comparing of said value of said hand to said tertiary wager hand value; and resolving said tertiary wager responsive to a determination of said outcome of said tertiary wager.

23. The method of claim 22 wherein said tertiary wager hand value is a predetermined value.

24. The method of claim 22 wherein said tertiary wager hand value is each of a plurality of values in a payoff table.

25. The method claim 22 wherein said tertiary wager hand value is a random value.

26. The method of claim 22 wherein said tertiary wager hand value is a value of a hand of a plurality of cards determined in accordance with the rules of cribbage.

27. The method of claim 2 wherein said step of determining said value of said player hand comprises:

1.) showing a card by a player;

2.) determining a card value of said card shown in accordance with cribbage pegging rules;

3.) adding said card value to said value of said hand; and

4.) determining whether said plurality of cards in said player hand are expended in accordance with cribbage pegging rules; and 5.) repeating steps 1–4 responsive to a determination that said plurality of cards in said player hand are not expended in accordance with cribbage pegging rules.

28. The method of claim 27 further comprising:

dealing a plurality of card to form a dealer hand to a dealer; and wherein said step of determining said value of said hand further comprises:

6.) showing a card from said dealer hand responsive to a player showing said card, 7.) determining a card value for said card shown by said dealer in accordance with rules for cribbage pegging, 8.) adding said card value to a dealer hand value, 9.) determining whether said plurality of card in said dealer hand are expended in accordance with cribbage pegging rules, and 10.) repeating steps 6–9 responsive to a determination that said plurality of cards in said dealers hand are expended in accordance with cribbage pegging rules.

29. The method of claim 28 wherein said step of dealing a plurality of cards to said player comprises dealing a plurality of cards to each of a plurality of players and steps 1–5 performed by each of said plurality of players.

30. The method of claim 28 wherein said step of determining said value of said hand of said player comprises:

adding said value of said dealer hand to said value of said player hand to determine said value of said hand of said player.

31. The method of claim 28 wherein said step of determining said value of said hand of said player comprises:

determining a difference between said value of said hand of said player and said value of said dealer hand.

32. The method of claim 31 wherein said step of determining said value of said hand of said player comprises:

making said difference said value of said player hand.

33. The method of claim 32 wherein said resolving said primary wager responsive to a determination of said outcome is performed by a multiplier of the wager.

34. The method of claim 28 wherein said primary wager hand value is determined by value of said dealer hand.

35. The method of claim 28 further comprising:

designating one of a plurality of players as said dealer.

36. The method of claim 27 wherein said step of dealing a plurality of cards to said player comprises dealing a plurality of cards to each of a plurality of players and steps 1–5 performed by each of said plurality of players, said method further comprising:

adding said value of said hand of each of said plurality of player to determine said value of said hand of each said player.

37. The method of claim 2 further comprising:

dealing a plurality of cards to a dealer to form a dealer hand; and determining a value of said dealer hand in accordance to rules of cribbage.

38. The method of claim 37 wherein said value of said dealer hand is said hand value attainment wagered on by the primary wager.

39. The method of claim 37 further comprising: discarding at least one of said plurality of cards from said dealer hand.

40. The method of claim 37 further comprising: dealing a starter card.

41. The method of claim 37 wherein said step of determining said value of said dealer hand comprises:

determining a value of said dealer hand from said plurality of cards in said dealer hand and said starter card.

42. The method of claim 37 wherein a secondary wager hand value is said value of said dealer hand.

43. The method of claim 37 further comprising: comparing said value of said dealer hand to a primary wager value; and determining an outcome of said primary wager responsive to a comparison of said value of said dealer hand and said primary wager hand value.

44. The method of claim 37 further comprising: designating one of a plurality of players as a dealer.

45. The method of claim 2 wherein said steps are executed by a processing system that displayers images of said cards on a display and receives inputs from said player.

46. The method of claim 2 further comprising: making a plurality of hands including at least one card from said plurality of cards in said hand of said player.

47. The method of claim 46 wherein said step of determining said value of said hand of said player comprises:

determining a value for each of said plurality of hands made by said player in accordance with the rules of cribbage.

48. The method of claim 47 where said step of determining said value of said hand of said player further comprises:

adding the values of each of said plurality of hands to determine said value of said hand of said player.

49. The method of claim 47 further comprising:

dealing a plurality of cards to a dealer to form a dealer hand;

creating a plurality of hands of at least two cards from said plurality of cards in said dealer hand;

determining a value of each of said plurality of hands created from said dealer hand in accordance with rules of cribbage;

adding said values of each of said plurality of hands to determine said value of said dealer hand; and wherein said primary wager hand value is said value of said dealer hand.

50. The method of claim 2 further comprising:

playing a second portion of a game responsive to a determination that said player won a wager;

determining whether said player wins said second portion of said game; and rewarding said player responsive to a determination that said player wins said second portion.

51. The method of claim 50 wherein said playing said second portion comprises:

determining a difference between said primary wager hand value and said value of said player hand; and comparing said difference to a bonus value.

52. The method of claim 51 wherein said bonus value is a predetermined value.

53. The method of claim 51 wherein said bonus value is each of a plurality of values in a payoff table.

54. The method of claim 51 wherein said bonus value is a random value.

55. The method of claim 51 wherein said bonus value is a value of a hand of a plurality of cards determined in accordance to the rules of cribbage.

56. The method of 50 wherein playing said second portion of said game comprises:

dealing a subsequent plurality of cards to said player to form a subsequent hand;

determining a value of said subsequent hand in accordance to cribbage scoring.

57. The method of claim 56 further comprising:

adding said value of said subsequent hand to said value of said player hand to generate a total.

58. The method of claim 57 further comprising:

comparing said value of said subsequent hand to a primary wager value;

determining an outcome of said subsequent hand responsive to said comparison; and resolving said primary wager responsive to a determination of said outcome.

59. A method for providing wagering in a game based upon the rules of cribbage comprising:

receiving a primary wager on a player hand from a player;

dealing a plurality of cards forming said player hand to said player;

determining a value of said hand in accordance to cribbage scoring;

comparing said value of said player hand to hand value attainment wagered on by the primary wager;

determining an outcome of said player hand responsive to said comparison; and resolving said primary wager responsive to a determination of said outcome, further comprising:

playing a second portion of a game responsive to a determination that said player won a wager;

determining whether said player wins said second portion of said game; and rewarding said player responsive to a determination that said player wins said second portion;

wherein playing said second portion of said game comprises:

dealing a subsequent plurality of cards to said player to form a subsequent hand;

determining a value of said subsequent hand in accordance to cribbage scoring; and adding said value of said subsequent hand to said value of said player hand to generate a total wherein said step of playing said secondary portion further comprises:

dealing a subsequent plurality of cards to a dealer to form a subsequent dealer hand; and determining a value of said subsequent dealer hand in accordance to rules of cribbage.

60. The method of claim 59 wherein said step of playing said secondary portion of said game further comprises:

adding said value of said subsequent dealer hand to said value of said dealer hand to determine a total value.

61. The method of claim 60 wherein said step of playing said secondary portion of said game further comprises:

determining whether said total value of said player hand is greater than said greater value of said dealer hand; and determining said player wins said second portion response to a determination that said total value of said player hand is greater than said total value of said dealer hand.

62. The method of claim 60 wherein said step of playing said secondary portion of said game further comprises:

determining whether said total value of said player hand is greater than a predetermined value; and determining whether said total value of said dealer hand is greater than said predetermined value; and repeating said step of secondary portion responsive to a determination that said total value of said player and said total value of said dealer are not greater than said predetermined value.

63. The method of claim 62 wherein said step of playing said secondary portion of said game further comprises:

determining said player wins said second portion responsive to said total value of said player hand is greater than said predetermined value and said total value of said dealer hand is not greater than said predetermined value.

64. The method of claim 62 wherein said step of playing said secondary portion of said game further comprises:

determining said player loses said second portion responsive to said total value of said player hand is not greater than said predetermined value and said total value of said dealer hand is greater than said predetermined value.

65. The method of claim 59 wherein said step of playing said secondary portion of said game further comprises:

dealing a starter card.

66. The method of claim 65 wherein said step of determining said value of said subsequent hand of said player is determined from said subsequent plurality of cards in said subsequent player hand and said starter card in accordance to rules of cribbage.

67. The method of claim 65 wherein said step of determining said value of said subsequent hand of said dealer is determined from said subsequent plurality of cards in said subsequent dealer hand and said starter card in accordance to rules of cribbage.

68. The method of claim 59 wherein said step of playing said second portion further comprises:

playing a pegging portion of a cribbage game with said subsequent player hand and said subsequent dealer hand.

69. The method of claim 68 wherein said step of playing said second portion further comprises:

determining a pegging score for said player; and adding said pegging score to said value of said subsequent hand of said player.

70. The method claim 68 wherein said step of playing said second portion further comprises:

determining a pegging score for said dealer; and adding said pegging score to said value of said subsequent hand of said dealer.

71. The method of claim 59 wherein said step of playing said second portion further comprises:

generating a crib hand with a plurality of cards;

determining a value of said crib hand;

comparing said value of said crib hand to a crib bonus value; and determining said player wins responsive to a comparison of said value of said crib hand and said crib bonus value.

72. The method of claim 71 wherein said crib value is a predetermined value.

73. The method of claim 71 wherein said crib value is a random value.

74. The method of claim 71 wherein said crib value is each of a plurality of values of a payoff chart.

* * * * *